US010864751B2

(12) United States Patent
Ueda et al.

(10) Patent No.: US 10,864,751 B2
(45) **Date of Patent: *Dec. 15, 2020**

(54) INKJET RECORDING APPARATUS

(71) Applicant: KYOCERA Document Solutions Inc., Osaka (JP)

(72) Inventors: Hiroyuki Ueda, Osaka (JP); Susumu Hiroshima, Osaka (JP); Takeshi Watanabe, Osaka (JP); Takatoshi Nishimura, Osaka (JP); Hiroatsu Tamai, Osaka (JP); Noriaki Ozawa, Osaka (JP); Toyotsune Inoue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/827,514

(22) Filed: Mar. 23, 2020

(65) Prior Publication Data

US 2020/0215830 A1 Jul. 9, 2020

Related U.S. Application Data

(62) Division of application No. 15/987,299, filed on May 23, 2018, now Pat. No. 10,632,763.

(30) Foreign Application Priority Data

May 26, 2017 (JP) ..... 2017-104352
May 26, 2017 (JP) ..... 2017-104353

(51) Int. Cl.
*B41J 29/38* (2006.01)
*B41J 11/00* (2006.01)
(Continued)

(52) U.S. Cl.
CPC ..... *B41J 11/0005* (2013.01); *B41J 2/125* (2013.01); *B41J 11/0045* (2013.01);
(Continued)

(58) Field of Classification Search
CPC ..... B41J 11/0005; B41J 2/125; B41J 11/002
See application file for complete search history.

(56) References Cited

U.S. PATENT DOCUMENTS 6,908,189 B2 6/2005 Miyamoto et al.
7,229,167 B2 6/2007 Miyamoto et al.
(Continued)

FOREIGN PATENT DOCUMENTS

JP 2003-291332 A 10/2003
JP 2003-302860 A 10/2003
(Continued)

OTHER PUBLICATIONS

An Office Action; "Notification of Reasons for Refusal," mailed by the Japanese Patent Office dated Feb. 25, 2020, which corresponds to Japanese Patent Application No. 2017-104353 and is related to U.S. Appl. No. 15/987,299; with English language translation.

*Primary Examiner* — Lam S Nguyen
(74) *Attorney, Agent, or Firm* — Studebaker & Brackett PC

(57) ABSTRACT

An inkjet recording apparatus includes an image forming section, a roller, a heat source, a calculator, a determination section, and a controller. The determination section determines to activate the heat source when an ink ejection amount calculated by the calculator is larger than a specific reference amount. When the determination section determines to activate the heat source, the controller activates the heat source. When temperature of the roller is equal to or higher than a specific temperature, the controller controls the image forming section to form the image on the sheet.

8 Claims, 19 Drawing Sheets

(51) Int. Cl.

| | |
|---|---|
| ***B65H 29/12*** | (2006.01) |
| ***B65H 29/70*** | (2006.01) |
| ***B41J 2/125*** | (2006.01) |
| ***B65H 29/60*** | (2006.01) |
| *B41J 3/60* | (2006.01) |

(52) U.S. Cl.
CPC ..... *B65H 29/125* (2013.01); *B65H 29/60* (2013.01); *B65H 29/70* (2013.01); *B41J 3/60* (2013.01); *B65H 2301/33312* (2013.01)

(56) References Cited

U.S. PATENT DOCUMENTS

| | | | | |
|---|---|---|---|---|
| 7,369,787 | B2 * | 5/2008 | Otsuka | G03G 15/2039 399/406 |
| 10,350,910 | B2 * | 7/2019 | Miwa | B32B 15/12 |
| 2003/0137572 | A1 | 7/2003 | Miyamoto et al. | |
| 2003/0156176 | A1 | 8/2003 | Miyamoto et al. | |
| 2004/0095451 | A1 | 5/2004 | Tatsumi et al. | |
| 2004/0202491 | A1 * | 10/2004 | Sakai | G03G 15/2039 399/69 |
| 2009/0073211 | A1 | 3/2009 | Imoto | |
| 2016/0375702 | A1 | 12/2016 | Kobashi et al. | |

FOREIGN PATENT DOCUMENTS

| | | | |
|---|---|---|---|
| JP | 2007-261691 | A | 10/2007 |
| JP | 2008-030881 | A | 2/2008 |
| JP | 2010-228260 | A | 10/2010 |

* cited by examiner

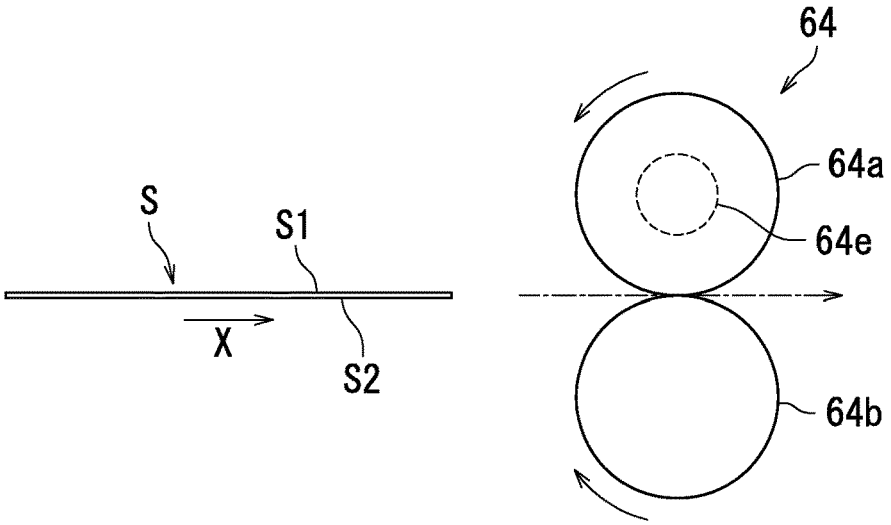
FIG. 4A
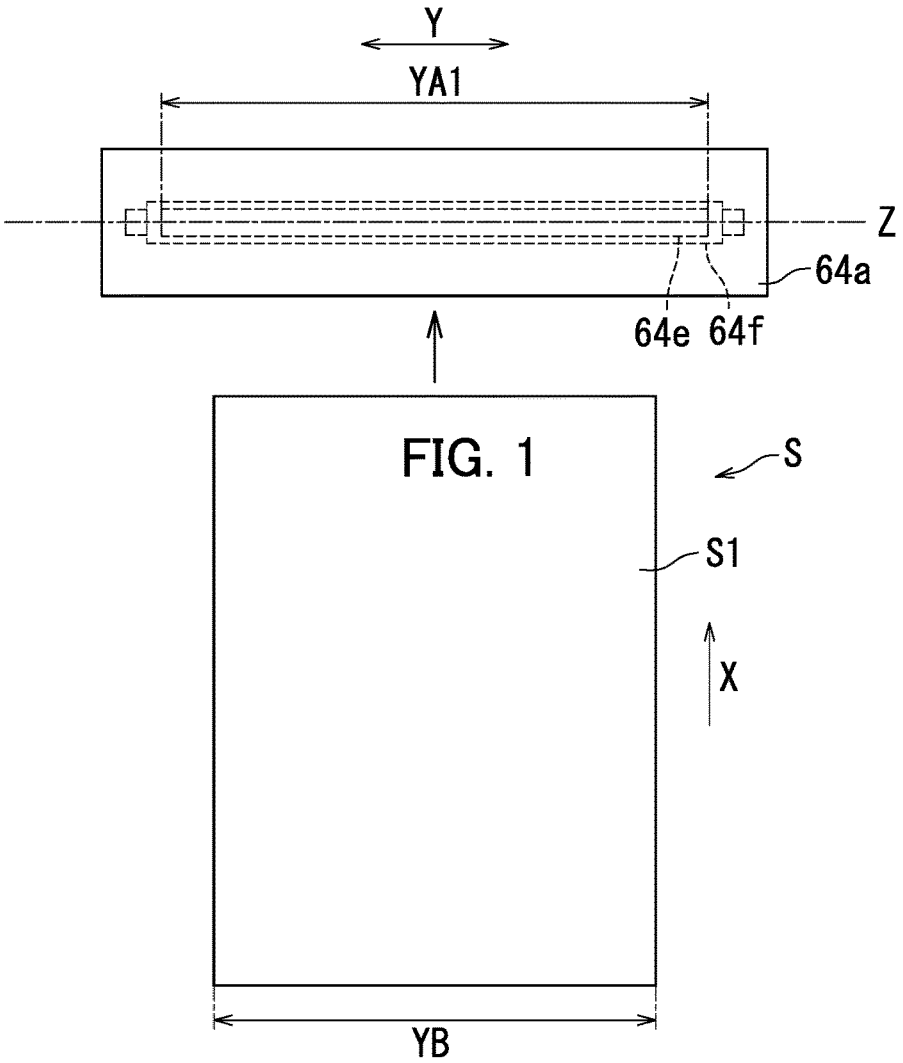
FIG. 1
FIG. 4B

INKJET RECORDING APPARATUS

INCORPORATION BY REFERENCE

The present application is a Divisional of U.S. patent application Ser. No. 15/987,299 filed May 23, 2018, which claims priority under 35 U.S.C. § 119 to Japanese Patent Applications Nos. 2017-104352 and 2017-104353, each filed on May 26, 2017. The contents of these applications are incorporated herein by reference in their entirety.

BACKGROUND

The present disclosure relates to an inkjet recording apparatus.

An inkjet recording apparatus includes a formation means, an acquisition means, a drying means, and a control means. The formation means forms an image according to recorded information by ejecting ink toward a recording medium. The acquisition means acquires based on the recorded information a distribution of ink ejection amounts of ink to be ejected in a direction across a sheet conveyance direction of the recording medium with the image formed thereon by the formation means. The drying means dries the recording medium with the image formed thereon by the formation means. The drying means includes a plurality of blowers and a plurality of partition walls. The blowers send heat of a heat source toward the recording medium. The partition walls stand in the sheet conveyance direction of the recording medium between a changing means and the recording medium and partition wind generated by the blowers. The control means performs control on the changing means according to the distribution of the ink ejection amounts acquired by the acquisition means so that drying temperature is higher in a region of the recording medium having a larger ink ejection amount than in a region thereof having a smaller ink ejection amount.

SUMMARY

According to a first aspect of the present disclosure, an inkjet recording apparatus includes an image forming section, a first roller, a first heat source, a calculator, a determination section, and a controller. The image forming section forms an image on a sheet. The first roller conveys the sheet. The first heat source heats the first roller. The calculator calculates an ink ejection amount of ink to be ejected toward the sheet. The determination section determines whether or not to activate the first heat source based on a calculation result of the calculator. The controller controls the first heat source and the image forming section based on a determination result of the determination section. The determination section determines to activate the first heat source when the ink ejection amount calculated by the calculator is larger than a specific reference amount. When the determination section determines to activate the first heat source, the controller activates the first heat source. When temperature of the first roller is equal to or higher than a specific temperature, the controller controls the image forming section to form the image on the sheet.

BRIEF DESCRIPTION OF THE DRAWINGS

FIG. 4A is a side view of the second decurler. FIG. 4B is a plan view of a first dryer roller and a sheet.

DETAILED DESCRIPTION

Figure 1:
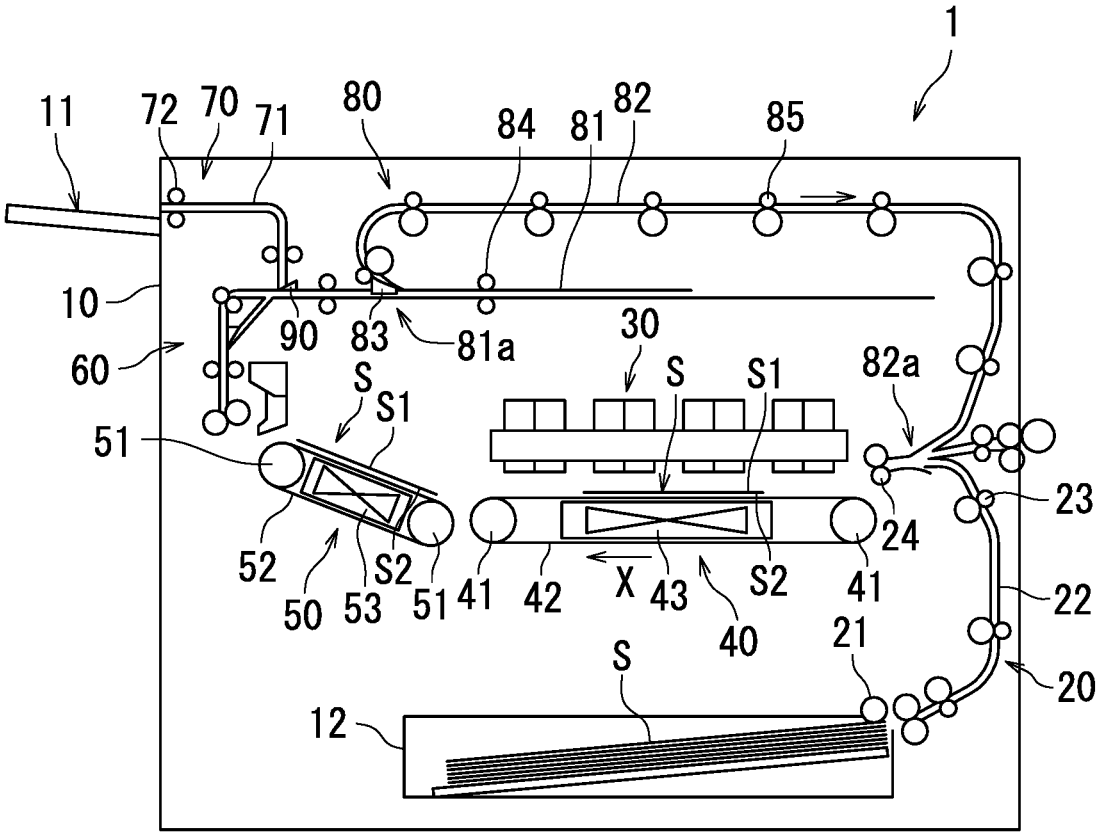
FIG. 1 is a schematic diagram of an inkjet recording apparatus according to an embodiment of the present disclosure.

Description will be made below about embodiments of the present disclosure with reference to the accompanying drawings. Note that elements in the drawings that are the same or equivalent are labelled using the same reference signs and description thereof is not repeated.

First Embodiment

The following describes an inkjet recording apparatus 1 according to a first embodiment of the present disclosure with reference to FIG. 1. FIG. 1 is a schematic diagram illustrating the inkjet recording apparatus 1.

As illustrated in FIG. 1, the inkjet recording apparatus 1 is capable of performing duplex printing on a sheet S. Specifically, the inkjet recording apparatus 1 includes a casing 10, an exit tray 11, an accommodation section 12, a first conveyor device 20, an image forming device 30, a second conveyor device 40, a third conveyor device 50, a fourth conveyor device 60, an ejection device 70, a returning device 80, and a first diverging guide 90.

The casing 10 accommodates the accommodation section 12, the first conveyor device 20, the image forming device 30, the second conveyor device 40, the third conveyor device 50, the fourth conveyor device 60, the ejection device 70, and the returning device 80. The exit tray 11 is disposed on an outer surface of the casing 10.

The accommodation section 12 accommodates sheets S. The accommodation section 12 is for example a cassette. Examples of the sheets S include plain paper, thick paper, overhead projector (OHP) sheets, envelopes, postcards, and invoice sheets.

The first conveyor device 20 feeds a sheet S accommodated in the accommodation section 12. Specifically, the first conveyor device 20 includes a feeding roller 21, a feeding passage 22, a first roller 23, and a registration roller 24. The feeding roller 21 picks up the sheet S accommodated in the accommodation section 12 and feeds the picked one to the feeding passage 22. The feeding passage 22 is located between the accommodation section 12 and the image forming device 30. The first roller 23 is disposed on the feeding passage 22 and conveys the sheet S fed by the feeding roller 21 to the registration roller 24. The registration roller 24 is located upstream of the image forming device 30 in terms of a sheet conveyance direction X of the sheet S and directly before the image forming device 30. The sheet conveyance direction X of the sheet S refers to a direction in which the sheet S moves in the inkjet recording apparatus 1 when the inkjet recording apparatus 1 executes a job for image formation on the sheet S. The registration roller 24 feeds the sheet S conveyed by the first roller 23 to the image forming device 30 in synchronization with timing of image formation by the image forming device 30.

The image forming device 30 is disposed downstream of the first conveyor device 20 in terms of the sheet conveyance direction X. The image forming device 30 ejects ink. Specifically, the image forming device 30 includes a plurality of heads and the heads eject ink.

The image forming device 30 ejects ink toward the sheet S to form an image on the sheet S. Examples of colors of the ink include black, cyan, magenta, and yellow. The ink is for example a water-based ink.

The second conveyor device 40 is disposed opposite to the image forming device 30. Specifically, the second conveyor device 40 includes a pair of second rollers 41, a first belt 42, and a first suction section 43. The second rollers 41 are spaced from each other in terms of the sheet conveyance direction X. The first belt 42 is an endless belt. The first belt 42 is wound between the second rollers 41. The first belt 42 has a plurality of holes. The first belt 42 is rotated by rotation of the second rollers 41. The first suction section 43 is disposed within a loop of the first belt 42. The first suction section 43 sucks air through the holes of the first belt 42.

The second conveyor device 40 conveys the sheet S in the following manner.

The sheet S fed by the registration roller 24 is placed on the first belt 42. The first suction section 43 sucks air. As a result of suction, the sheet S adheres to the first belt 42 with a suction side S2 thereof in contact with the first belt 42. The first belt 42 rotates to convey the sheet S in the sheet conveyance direction X. In the following description, a side of the sheet S that is opposite to the suction side S2 will be referred to as an image formation side S1.

The image forming device 30 ejects ink toward the sheet S placed on the first belt 42. The image forming device 30 ejects ink toward the image formation side S1 of the sheet S to form an image on the image formation side S1. That is, frontside printing of duplex printing is performed on the sheet S. The image is formed from ink attached to the image formation side S1.

The third conveyor device 50 is disposed downstream of the image forming device 30 in terms of the sheet conveyance direction X. The third conveyor device 50 is disposed also downstream of the second conveyor device 40 in terms of the sheet conveyance direction X. The third conveyor device 50 conveys the sheet S to air-dry ink attached to the sheet S. Specifically, the third conveyor device 50 includes a pair of third rollers 51, a second belt 52, and a second suction section 53. The third rollers 51 are spaced from each other in terms of the sheet conveyance direction X. The second belt 52 is wound between the third rollers 51. The second belt 52 has a plurality of holes. The second belt 52 is rotated by rotation of the third rollers 51. The second suction section 53 is disposed within a loop of the second belt 52. The second suction section 53 sucks air through the holes of the second belt 52.

The third conveyor device 50 conveys the sheet S in the following manner.

The sheet S fed by the second conveyor device 40 is placed on the second belt 52. The second suction section 53 sucks air to cause the sheet S to adhere to the second belt 52 with the suction side S2 thereof in contact with the second belt 52. The second belt 52 rotates to covey the sheet S in the sheet conveyance direction X.

During conveyance of the sheet S by the third conveyor device 50, ink attached to the image formation side S1 of the sheet S is dried through exposure to the air. In the above configuration, ink drying can be accelerated for example by increasing the size of the third conveyor device 50 to increase a conveyance distance of the sheet S in the third conveyor device 50.

The fourth conveyor device 60 is disposed downstream of the third conveyor device 50 in terms of the sheet conveyance direction X. The fourth conveyor device 60 will be described later in detail.

The ejection device 70 is disposed downstream of the fourth conveyor device 60 in terms of the sheet conveyance direction X. The ejection device 70 ejects the sheet S having passed through the image forming device 30 out of the casing 10. Specifically, the ejection device 70 includes an ejection passage 71 and an ejection roller 72. The ejection passage 71 is located between the fourth conveyor device 60 and the exit tray 11. The ejection roller 72 ejects the sheet S conveyed through the ejection passage 71 onto the exit tray 11.

The returning device 80 is disposed downstream of the fourth conveyor device 60 in terms of the sheet conveyance direction X. Specifically, the returning device 80 includes a paper reversing passage 81, a paper returning passage 82, a second diverging guide 83, a reversing roller 84, and a returning roller 85.

The paper reversing passage 81 is connected to the fourth conveyor device 60. The paper returning passage 82 has ends one of which is connected to a joint part 81*a* between the paper reversing passage 81 and the fourth conveyor device 60. The other end of the paper returning passage 82 is connected to the feeding passage 22. A joint part 82*a* between the other end of the paper returning passage 82 and the feeding passage 22 is located upstream of the registration roller 24 in terms of the sheet conveyance direction X.

The second diverging guide 83 is disposed at the joint part 81*a*. The second diverging guide 83 is supported pivotally. The second diverging guide 83 is changeable in posture between a first guide posture and a second guide posture. The first guide posture refers to a posture of the second diverging guide 83 for which communication between the paper reversing passage 81 and the paper returning passage 82 is cut and communication between the paper reversing passage 81 and the fourth conveyor device 60 is established. The second guide posture refers to a posture of the second diverging guide 83 for which communication between the paper reversing passage 81 and the fourth conveyor device 60 is cut and communication between the paper reversing passage 81 and the paper returning passage 82 is established.

The reversing roller 84 is disposed on the paper reversing passage 81. The returning roller 85 is disposed on the paper returning passage 82.

The following describes a sequence in which the returning device 80 conveys the sheet S from the fourth conveyor device 60 to the feeding passage 22.

First, the second diverging guide 83 takes the first guide posture. As a result of the second diverging guide 83 being in the first guide posture, the second diverging guide 83 guides the sheet S from the fourth conveyor device 60 to the paper reversing passage 81.

Subsequently, the reversing roller 84 returns the sheet S from the paper reversing passage 81 to the second diverging guide 83.

Next, the second diverging guide 83 takes the second guide posture. As a result of the second diverging guide 83 being in the second guide posture, the second diverging guide 83 guides the sheet S from the paper reversing passage 81 to the paper returning passage 82.

Subsequently, the returning roller 85 conveys the sheet S from the paper returning passage 82 to the feeding passage 22.

The sheet S is re-conveyed to the image forming device 30 by the returning device 80.

The sheet S conveyed by the returning device 80 has been reversed between a front side (image formation side S1) and a back side (suction side S2). Also, the sheet S conveyed by the returning device 80 has been reversed in position between a leading edge and a trailing edge thereof in the sheet conveyance direction X. Accordingly, the sheet S is sucked to the first belt 42 with the image formation side S1 thereof in contact with the first belt 42. The image forming device 30 then ejects ink toward the suction side S2 of the sheet S to form an image. That is, backside printing of duplex printing is performed on the sheet S.

Figure 2:
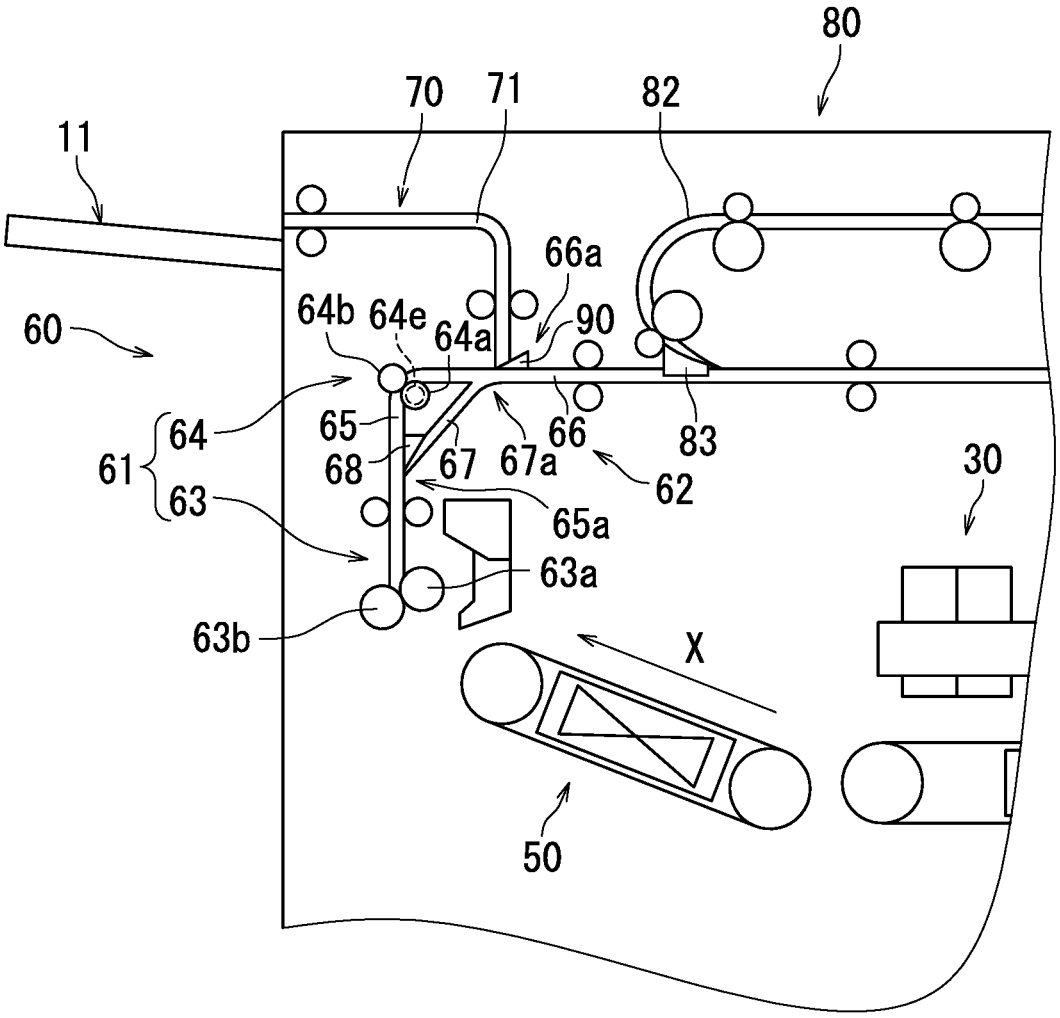
FIG. 2 is an enlarged view illustrating a fourth conveyor device and a first diverging guide.
Figure 3:
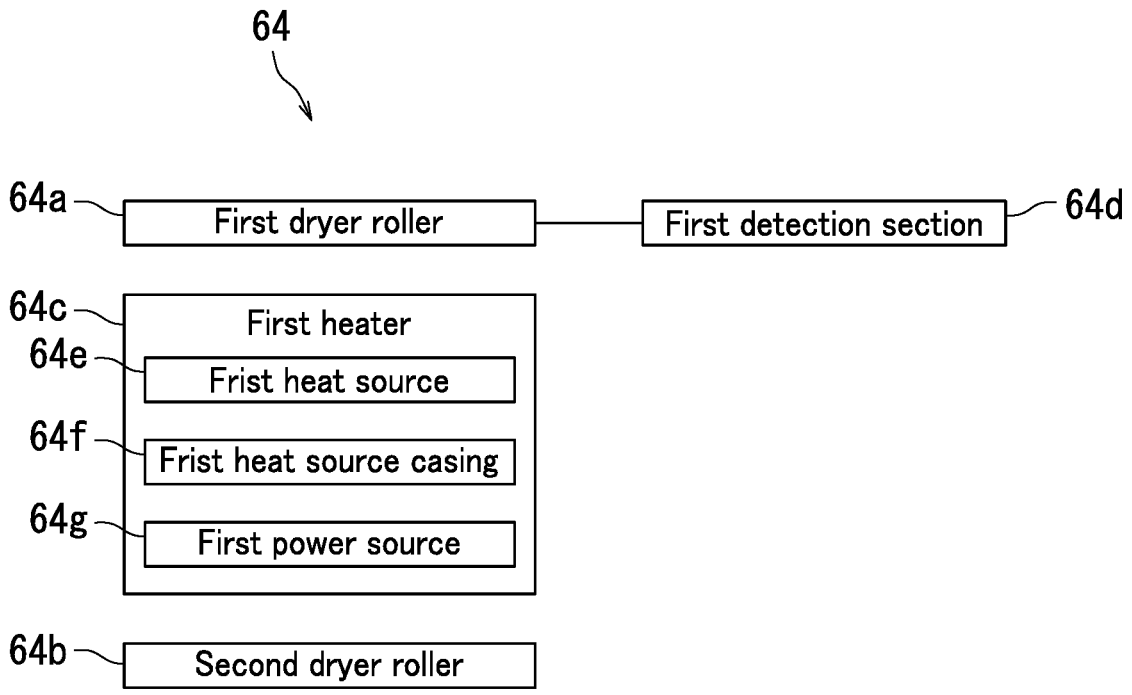
FIG. 3 is a block diagram illustrating a second decurler in a first embodiment.

The following describes the fourth conveyor device 60 and the first diverging guide 90 with reference to FIGS. 2 and 3. FIG. 2 is an enlarged view illustrating the fourth conveyor device 60 and the first diverging guide 90.

As illustrated in FIG. 2, the fourth conveyor device 60 includes a decurling device 61 and a guide section 62.

The decurling device 61 includes a first decurler 63 and a second decurler 64.

The sheet S is conveyed to the first decurler 63. The first decurler 63 is disposed downstream of the image forming device 30 in terms of the sheet conveyance direction X. The first decurler 63 is disposed also downstream of the third conveyor device 50 in terms of the sheet conveyance direction X. Accordingly, the sheet S having passed along the third conveyor device 50 is fed to the first decurler 63.

Specifically, the first decurler 63 includes a first decurling roller 63*a* and a second decurling roller 63*b*. The first and second decurling rollers 63*a* and 63*b* are supported in a rotatable manner. The first and second decurling rollers 63*a* and 63*b* rotate while holding the sheet S therebetween to convey the sheet S. Specifically, the first and second decurling rollers 63*a* and 63*b* rotate while holding the sheet S between respective outer circumferential surfaces thereof.

When the first and second decurling rollers 63*a* and 63*b* hold the sheet S therebetween, a part of the sheet S located between the first and second decurling rollers 63*a* and 63*b* is flattened. As a result, curling of the sheet S can be mitigated. Curling of the sheet S means curving of an edge of the sheet S toward the suction side S2 due to ink attachment to the image formation side S1 of the sheet S.

The first and second decurling rollers 63*a* and 63*b* are coated with either or both of ceramic particles and particles such as glass beads. In the above configuration, a contact area of the sheet S in contact with a unit area of the first decurling roller 63*a* can be reduced. Also, a contact area of the sheet S in contact with a unit area of the second decurling roller 63*b* can be reduced. As a result, transfer of ink attached to the sheet S to the first and second decurling rollers 63*a* and 63*b* can be inhibited.

The sheet S is conveyed to the second decurler 64. The second decurler 64 is disposed downstream of the image forming device 30 in terms of the sheet conveyance direction X. The second decurler 64 is disposed also downstream of the first decurler 63 in terms of the sheet conveyance direction X.

FIG. 3 is a block diagram illustrating the second decurler 64 in the first embodiment.

Specifically, the second decurler 64 includes a first dryer roller 64*a*, a second dryer roller 64*b*, a first heater 64*c*, and a first detection section 64*d*, as illustrated in FIGS. 2 and 3. The first and second dryer rollers 64*a* and 64*b* are supported in a rotatable manner. The first and second dryer rollers 64*a* and 64*b* rotate while holding the sheet S therebetween to convey the sheet S. Specifically, the first and second dryer rollers 64*a* and 64*b* rotate while holding the sheet S between respective outer circumferential surfaces thereof. The first dryer roller 64*a* is an example of a first roller in the present disclosure. The second dryer roller 64*b* is an example of a second roller in the present disclosure.

The first and second dryer rollers 64*a* and 64*b* are coated with either or both of ceramic particles and particles such as glass beads. In the above configuration, a contact area of the sheet S in contact with a unit area of the first dryer roller 64*a* can be reduced. Also, a contact area of the sheet S in contact with a unit area of the second dryer roller 64*b* can be reduced. As a result, transfer of ink attached to the sheet S to the first and second dryer rollers 64*a* and 64*b* can be inhibited.

The first heater 64*c* is for example a halogen heater. Specifically, the first heater 64*c* includes a first power source 64*g*, a first heat source 64*e*, and a first heat source casing 64*f* that accommodates the first heat source 64*e*.

The first heat source 64*e* is a member capable of heat generation. The first heat source 64*e* is for example a filament.

The first heat source 64*e* is disposed at the first dryer roller 64*a*. The first heat source 64*e* is embedded in the first dryer roller 64*a* in the present embodiment. A configuration in which the first heat source 64*e* is embedded in the first dryer roller 64*a* encompasses a configuration in which the first dryer roller 64*a* has a hollow space in which the first heat source 64*e* is disposed and a configuration in which the first dryer roller 64*a* has a substantially hollow cylindrical shape with the first heat source 64*e* disposed in a space surrounded by an inner circumferential surface of the first dryer roller 64*a*. The first heat source 64*e* is mounted for example at either or both of the first dryer roller 64*a* and a first shaft member. The first shaft member is inserted through the first dryer roller 64*a* to support the first dryer roller 64*a* in a rotatable manner.

The first power source 64*g* supplies power to the first heat source 64*e* to activate the first heat source 64*e*. The first power source 64*g* is an electric power supply in the present embodiment. In the above configuration, the first power source 64*g* supplies electric power to the first heat source 64*e* to activate the first heat source 64*e*. As a result of power supply, the first heat source 64*e* generates heat to increase the temperature of the first dryer roller 64*a*.

The first detection section 64*d* detects the temperature of the first dryer roller 64*a*. Detection of the temperature of the first dryer roller 64*a* encompasses detection of the temperature of the first heat source 64*e* and detection of the temperature of the first heat source casing 64*f*. The first detection section 64*d* is for example constituted by a thermistor.

The guide section 62 guides the sheet S. Specifically, the guide section 62 includes a first guide passage 65, a second guide passage 66, a third guide passage 67, and a third diverging guide 68.

The first guide passage 65 is located upstream of the second decurler 64 in terms of the sheet conveyance direction X. The first guide passage 65 has ends one of which is connected to the first decurler 63. The other end of the first guide passage 65 is connected to the second decurler 64.

The second guide passage 66 is located downstream of the second decurler 64 in terms of the sheet conveyance direction X. The second guide passage 66 has ends one of which is connected to the second decurler 64. Accordingly, the second decurler 64 is located between the second and first guide passages 66 and 65.

The other end of the second guide passage 66 is connected to the returning device 80. Specifically, the other end of the second guide passage 66 is connected to the paper reversing passage 81. The ejection passage 71 is connected to a mid-part of the second guide passage 66.

The third guide passage 67 connects the first and second guide passages 65 and 66 directly not via the second decurler 64. The third guide passage 67 has ends one of which is connected to a mid-part of the first guide passage 65. The other end of the third guide passage 67 is connected to a mid-part of the second guide passage 66. In the above configuration, the third guide passage 67 diverges from the first guide passage 65 and leads to the second guide passage 66.

A joint part 67*a* between the third and second guide passages 67 and 66 is located upstream of a joint part 66*a* between the second guide passage 66 and the ejection passage 71 in terms of the sheet conveyance direction X. In the above configuration, the sheet S having passed through the third guide passage 67 can be conveyed to the ejection passage 71 and ejected out onto the exit tray 11.

The third diverging guide (diverging guide) 68 is disposed at a joint part 65*a* between the first and third guide passages 65 and 67. The third diverging guide 68 is supported pivotally. The third diverging guide 68 is changeable in posture between a third guide posture and a fourth guide posture. The third guide posture refers to a posture of the third diverging guide 68 for which communication between the first and third guide passages 65 and 67 is cut and communication between the first guide passage 65 and the second decurler 64 is established. The fourth guide posture refers to a posture of the third diverging guide 68 for which communication between the first guide passage 65 and the second decurler 64 is cut and communication between the first and third guide passages 65 and 67 is established.

When the third diverging guide 68 is in the third guide posture, the sheet S is conveyed to the first guide passage 65, the second decurler 64, and the second guide passage 66 in the stated order.

By contrast, when the third diverging guide 68 is in the fourth guide posture, the sheet S is conveyed to the first guide passage 65, the third guide passage 67, and the second guide passage 66 in the stated order. In the above configuration, the sheet S is conveyed to the second guide passage 66 not via the second decurler 64 when the third diverging guide 68 is in the fourth guide posture.

The first diverging guide 90 is disposed at the joint part 66*a*. The first diverging guide 90 is supported pivotally. The first diverging guide 90 is changeable in posture between a fifth guide posture and a sixth guide posture. The fifth guide posture refers to a posture of the first diverging guide 90 for which communication between the second guide passage 66 and the ejection passage 71 is cut and communication between the second guide passage 66 and the returning device 80 is established. The sixth guide posture refers to a posture of the first diverging guide 90 for which communication between the second guide passage 66 and the returning device 80 is cut and communication between the second guide passage 66 and the ejection passage 71 is established.

When the first diverging guide 90 is in the fifth guide posture, the sheet S is conveyed from the second guide passage 66 to the returning device 80. Subsequently, backside printing is performed on the sheet S.

By contrast, when the first diverging guide 90 is in the sixth guide posture, the sheet S is conveyed from the second guide passage 66 to the ejection passage 71. Subsequently, the sheet S is ejected onto the exit tray 11.

As described with reference to FIGS. 2 and 3, the first heat source 64*e* is disposed at the first dryer roller 64*a*. In the above configuration, drying of ink attached to the sheet S can be accelerated with such a simple device configuration when compared to a decurling device that blows hot wind toward the sheet S.

Furthermore, the first heat source 64*e* heats the first dryer roller 64*a*. In the above configuration, drying of ink attached to the sheet S can be accelerated by the heat of the first dryer roller 64*a* during conveyance of the sheet S in a manner that the first and second dryer rollers 64*a* and 64*b* rotate while holding the sheet S therebetween. As a result, sheet curling can be mitigated and occurrence of problems such as sheet edge folding and a sheet jam can be prevented.

When the first and second dryer rollers 64*a* and 64*b* hold the sheet S therebetween, a part of the sheet S located between the first and second dryer rollers 64*a* and 64*b* is flattened. As a result, curling of the sheet S can be mitigated.

Mitigation of sheet curling can achieve effective suction of the sheet S to the first belt 42 in backside printing on the sheet S. Consequently, a lift of an edge of the sheet S from the first belt 42 can be prevented. As a result, a situation in which the sheet S is rubbed against the image forming device 30 can be prevented. Thus, smooth backside printing on the sheet S can be achieved.

Furthermore, when the sheet S is heated by the first dryer roller 64*a*, moisture in ink attached to the sheet S evaporates. Thus, ink drying can be accelerated. As a result, need to air-dry ink attached to the sheet S in the third conveyor device 50 is reduced. This can enable reduction in a distance by which the third conveyor device 50 conveys the sheet S or omission of the third conveyor device 50. Thus, size reduction of the inkjet recording apparatus 1 can be achieved.

Figure 5:
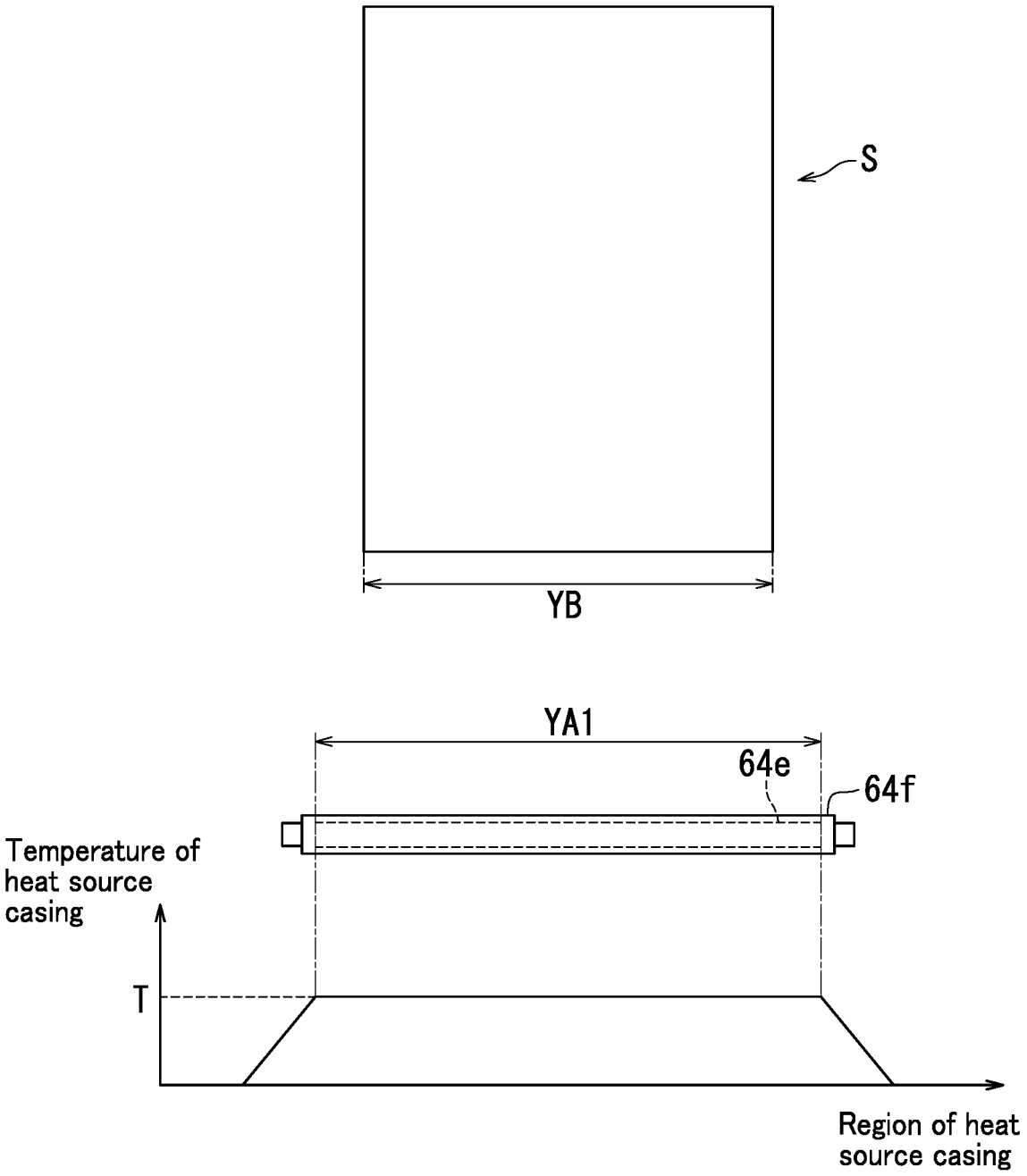
FIG. 5 is a diagram illustrating a relationship between regions and temperature of a heat source casing.

The following describes the second decurler 64 with reference to FIGS. 4A to 5. FIG. 4A is a side view of the second decurler 64. FIG. 4B is a plan view of the first dryer roller 64*a* and the sheet S. FIG. 5 is a diagram illustrating a relationship between regions and temperature of the first heat source casing 64*f*.

As illustrated in FIGS. 4A to 5, the first heat source 64*e* is disposed in the first dryer roller 64*a* along a rotational axis Z of the first dryer roller 64*a*. A dimension YA1 of the first heat source 64*e* in a transverse direction Y is larger than a dimension YB of the sheet S in the transverse direction Y (YA1≥YB). The transverse direction Y refers to a direction perpendicular to the sheet conveyance direction X of the sheet S. In the above configuration, the first heat source 64*e* heats substantially the entirety of the sheet S.

A portion of the first heat source casing 64*f* located opposite to the first heat source 64*e* is heated substantially uniformly to a specific temperature T. As a result, the first dryer roller 64*a* is heated to the specific temperature T. Note that the specific temperature T is determined in advance. The specific temperature T is a temperature suitable for accelerating drying of ink attached to the sheet S and is determined for example by an experiment.

When the first and second dryer rollers 64*a* and 64*b* hold the sheet S therebetween, the first dryer roller 64*a* is opposite to the image formation side S1 of the sheet S while the second dryer roller 64*b* is opposite to the suction side S2 thereof. Accordingly, the image formation side S1 of the sheet S is heated by the first dryer roller 64*a*.

The first and second dryer rollers 64*a* and 64*b* rotate while holding the sheet S therebetween. As a result, the sheet S passes between the first and second dryer rollers 64*a* and 64*b* while receiving heat from the first dryer roller 64*a*.

As described above with reference to FIGS. 4A to 5, the first dryer roller 64*a* is opposite to the image formation side S1 of the sheet S. In the above configuration, heat of the first dryer roller 64*a* is directly transferred to the image formation side S1 of the sheet S. As a result, drying of the ink attached to the sheet S can be effectively accelerated.

Figure 6:
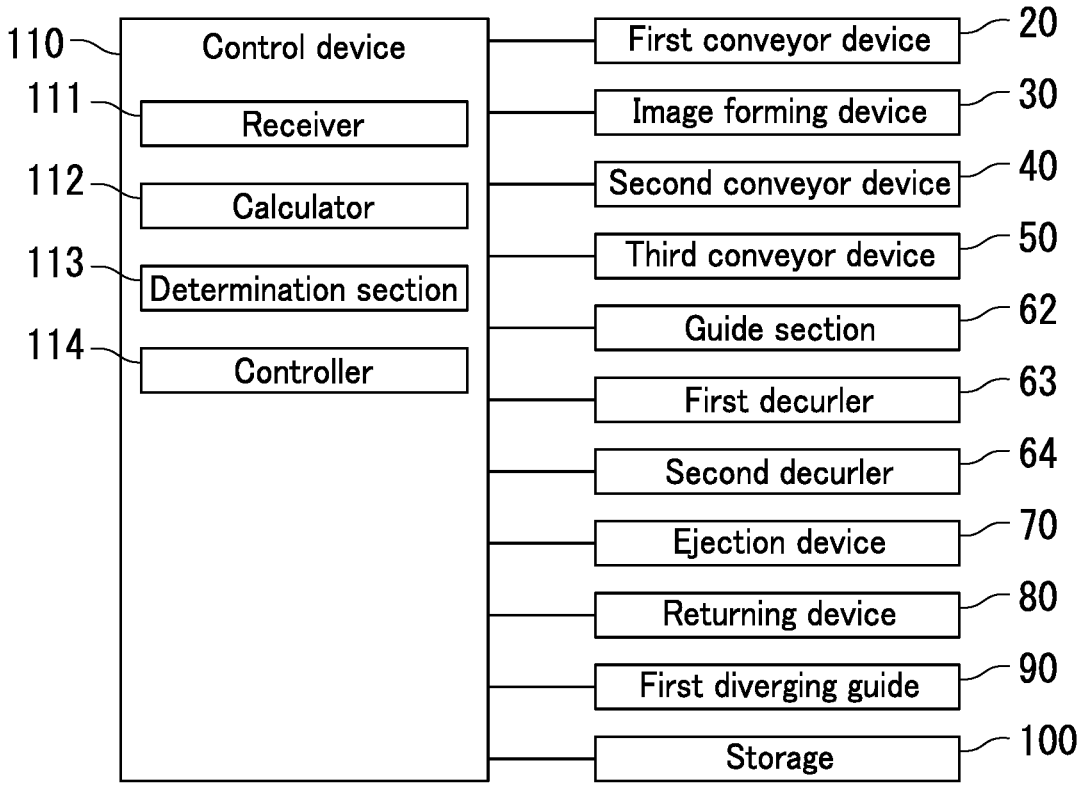
FIG. 6 is a block diagram illustrating the inkjet recording apparatus.
Figure 7A:
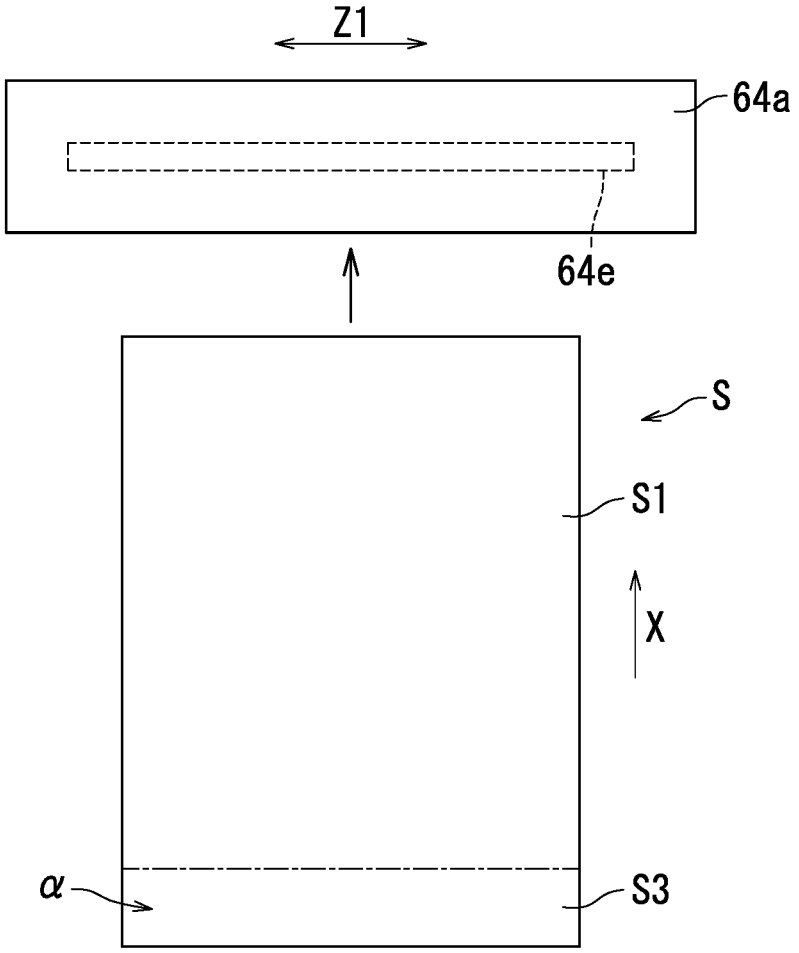
FIG. 7A is a plan view of the first dryer roller and a sheet.
Figure 7B:
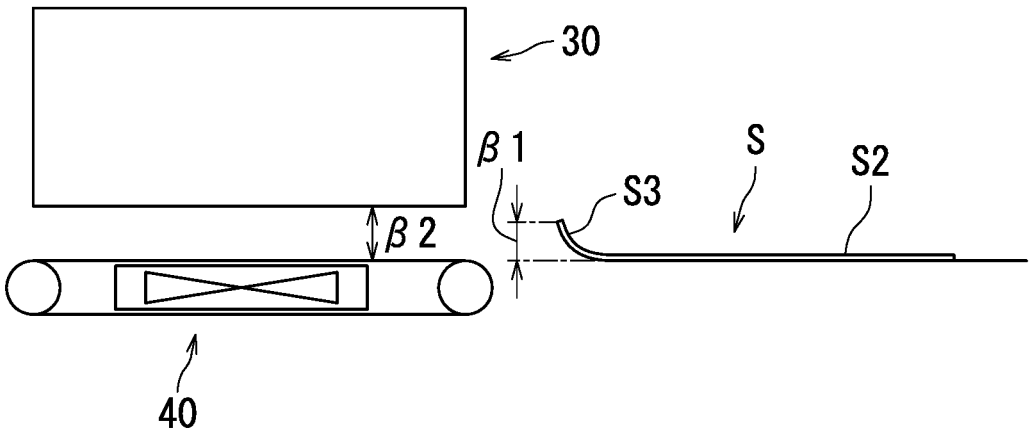
FIG. 7B is a side view of an image forming device and the sheet.

The following describes the inkjet recording apparatus 1 with reference to FIGS. 6 to 7B. FIG. 6 is a block diagram illustrating the inkjet recording apparatus 1. FIG. 7A is a plan view of the first dryer roller 64*a* and the sheet S in frontside printing on the sheet S. FIG. 7B is a side view of the image forming device 30 and the sheet S in backside printing on the sheet S.

As illustrated in FIGS. 6 to 7B, the inkjet recording apparatus 1 further includes storage 100 and a control device 110.

The storage 100 includes a storage device. The storage device includes a main storage device (e.g., semiconductor memory) such as read only memory (ROM) or random access memory (RAM) and may further include an auxiliary storage device (e.g., a hard disk drive). Either or both of the main storage device and the auxiliary storage device store therein various computer programs that are executed by the control device 110.

The storage 100 stores therein information indicating the specific temperature T.

The control device 110 includes a processor such as a central processing unit (CPU) or a micro processing unit (MPU). The control device 110 controls respective elements of the inkjet recording apparatus 1. Specifically, the processor executes computer programs stored in the storage device to control the first conveyor device 20, the image forming device 30, the second conveyor device 40, the third conveyor device 50, the fourth conveyor device 60, the ejection device 70, the returning device 80, the first diverging guide 90, and the storage 100.

The control device 110 includes a receiver 111, a calculator 112, a determination section 113, and a controller 114. Specifically, the processor executes computer programs stored in the storage device to function as the receiver 111, the calculator 112, the determination section 113, and the controller 114.

The receiver 111 receives image data. The image data is data representing an image that the image forming device 30 is to form on the sheet S. The receiver 111 receives for example the image data from an external computer. In a configuration in which the inkjet recording apparatus 1 includes an image reading section, the receiver 111 is capable of receiving the image data from the image reading section.

The calculator 112 acquires the image data from the receiver 111. The calculator 112 calculates an ink ejection amount based on the image data. Specifically, the ink ejection amount refers to an amount of ink that the image forming device 30 is to eject toward a region α of the sheet S located at a trailing edge S3 thereof as illustrated in FIG. 7A. The trailing edge S3 of the sheet S refers to a trailing edge of the sheet S in the sheet conveyance direction X in frontside printing on the sheet S. The region α represents for example a region liable to curling upon ink attachment. The size of the region α is determined for example by an experiment. Information representing the region α is stored in the storage 100 in advance.

The determination section 113 determines based on the ink ejection amount calculated by the calculator 112 whether or not to activate the first heat source 64*e*. To activate the first heat source 64*e* means power supply by the first power source 64*g* to the first heat source 64*e* to increase the temperature of the first heat source 64*e*.

When the ink ejection amount calculated by the calculator 112 is larger than a specific reference amount, the determination section 113 determines to activate the first heat source 64*e*. By contrast, when the ink ejection amount calculated by the calculator 112 is equal to or smaller than the specific reference amount, the determination section 113 determines not to activate the first heat source 64*e*. Non-activation of the first heat source 64*e* means no power supply by the first power source 64*g* to the first heat source 64*e*. The specific reference amount indicates a maximum value of the ink ejection amount in the region α in a condition in which the sheet S can be smoothly conveyed with occurrence of problems such as a sheet jam prevented. The specific reference amount is determined for example by an experiment. Information representing the specific reference amount is stored in the storage 100 in advance.

The following describes an example of the specific reference amount with reference to FIG. 7B. The specific reference amount indicates for example a maximum value of the ink ejection amount in the region α when a curl at the trailing edge S3 of the sheet S has a height 131 smaller than a distance β2 between the image forming device 30 and the second conveyor device 40. As such, the determination section 113 determines to activate the first heat source 64*e* when the ink ejection amount of ink to be ejected toward the region α is large and the curl is presumed to have a height β1 larger than the distance β2. By contrast, the determination section 113 determines not to activate the first heat source 64*e* when the ink ejection amount of ink to be ejected toward the region α is small and the curl is presumed to have a height β1 smaller than the distance β2.

The trailing edge S3 of the sheet S comes first in backside printing on the sheet S. When the specific reference amount is set as in the above example, the trailing edge S3 of the sheet S can be prevented from coming into contact with the image forming device 30 in backside printing on the sheet S. Furthermore, unnecessary activation of the first heat source 64*e* can be reduced with a result that efficient activation of the first heat source 64*e* can be achieved.

Description about the controller 114 will be continued with reference to FIG. 6. The controller 114 is connected to the first conveyor device 20 to control the first conveyor device 20. Specifically, the controller 114 controls the feeding roller 21, the first roller 23, and the registration roller 24.

The controller 114 is connected to the image forming device 30 to control the image forming device 30. Specifically, the controller 114 controls the image forming device 30 to eject ink toward the sheet S.

The controller 114 acquires the image data from the receiver 111. The controller 114 then controls the image forming device 30 based on the image data. In response, the image forming device 30 forms an image corresponding to the image data on the sheet S.

The controller 114 controls the first heat source 64*e* and the image forming device 30 based on a determination result by the determination section 113.

The controller 114 is connected to the second conveyor device 40 to control the second conveyor device 40. Specifically, the controller 114 controls the pair of second rollers 41, the first belt 42, and the first suction section 43.

The controller 114 is connected to the third conveyor device 50 to control the third conveyor device 50. Specifically, the controller 114 controls the pair of third rollers S1, the second belt 52, and the second suction section 53.

The controller 114 is connected to the guide section 62 to control the guide section 62. Specifically, the controller 114 controls the third diverging guide 68.

The controller 114 is connected to the first decurler 63 to control the first decurler 63. Specifically, the controller 114 controls the first and second decurling rollers 63*a* and 63*b*.

The controller 114 is connected to the second decurler 64 to control the second decurler 64. Specifically, the controller 114 controls the first and second dryer rollers 64*a* and 64*b*, the first heater 64*c*, and the first detection section 64*d*.

The controller 114 is connected to the ejection device 70 to control the ejection device 70. Specifically, the controller 114 controls the ejection roller 72.

The controller 114 is connected to the returning device 80 to control the returning device 80. Specifically, the controller 114 controls the second diverging guide 83, the reversing roller 84, and the returning roller 85.

The controller 114 is connected to the first diverging guide 90 to control the first diverging guide 90.

A motor for example is connected through a gear and a clutch to conveyance members that convey the sheet S, such as the feeding roller 21, the first roller 23, the registration roller 24, the second roller 41, the third roller S1, the third diverging guide 68, the first and second decurling rollers 63*a* and 63*b*, the first and second dryer rollers 64*a* and 64*b*, the ejection roller 72, the second diverging guide 83, the reversing roller 84, the returning roller 85, and the first diverging guide 90. The controller 114 operates for example the gear, the clutch, and the motor to control operation of the conveyance members.

Figure 8:
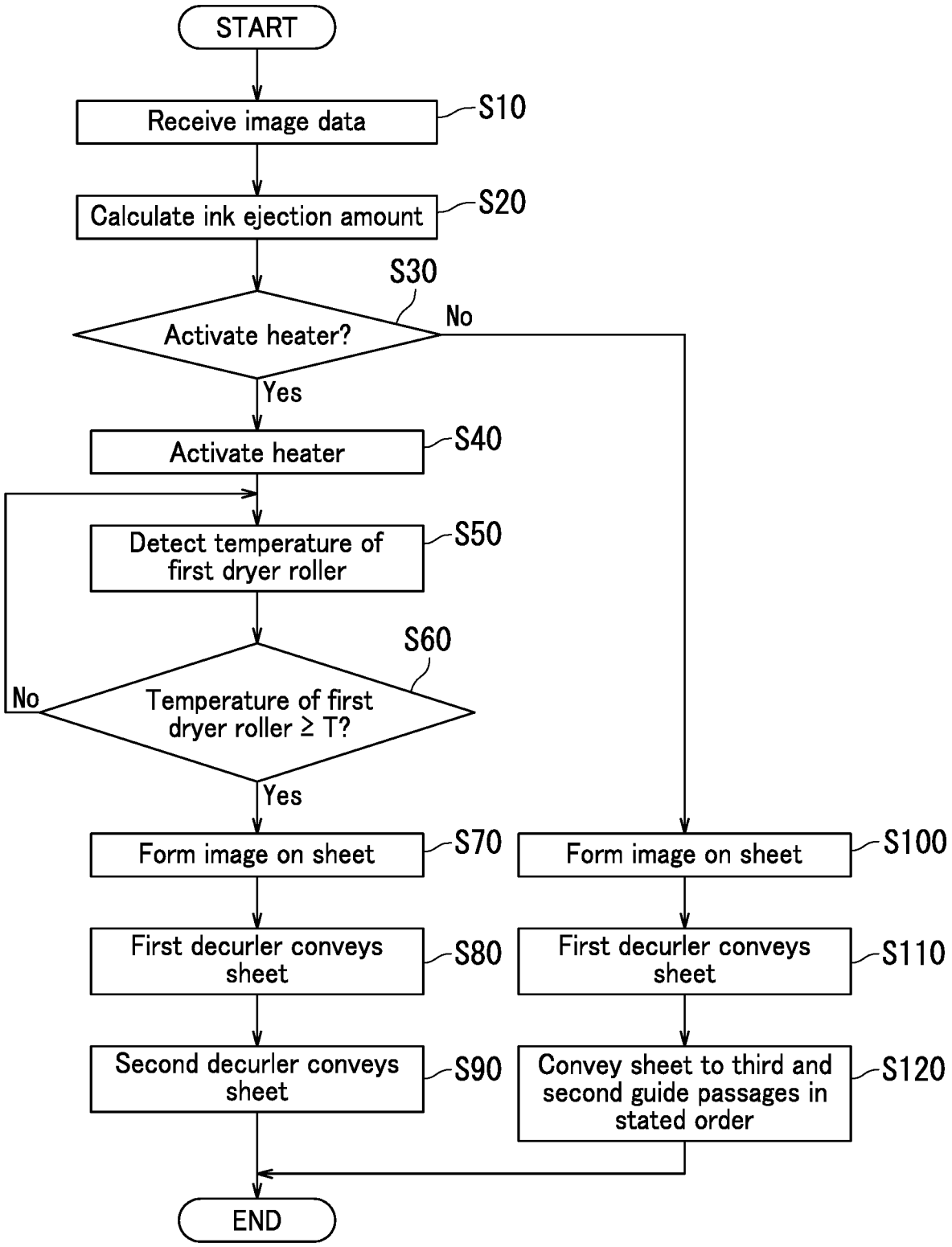
FIG. 8 is a flowchart depicting operation of a control device.

The following describes operation of the control device 110 with reference to FIG. 8. FIG. 8 is a flowchart depicting the operation of the control device 110.

As illustrated in FIG. 8, the receiver 111 receives image data representing an image to be formed on a sheet S at Step S10. The image data is transmitted for example from an external computer to the receiver 111.

The calculator 112 acquires the image data from the receiver 111 at Step S20. The calculator 112 calculates an ink ejection amount of ink to be ejected toward the region α of the sheet S located at the trailing edge S3 thereof.

At Step S30, the determination section 113 determines whether or not to activate the first heat source 64*e* based on the ink ejection amount calculated by the calculator 112. That is, the determination section 113 determines prior to image formation on the sheet S whether or not to activate the first heat source 64*e*.

When the ink ejection amount calculated by the calculator 112 is larger than the specific reference amount, the determination section 113 determines to activate the first heat source 64*e*. By contrast, when the ink ejection amount calculated by the calculator 112 is equal to or smaller than the specific reference amount, the determination section 113 determines not to activate the first heat source 64*e*.

When the determination section 113 determines to activate the first heat source 64*e* (Yes at Step S30), the routine proceeds to Step S40. When the determination section 113 determines not to activate the first heat source 64*e* (No at Step S30), the routine proceeds to Step S100.

At Step S40, the controller 114 activates the first heat source 64*e*.

At Step S50, the first detection section 64*d* detects the temperature of the first dryer roller 64*a*.

At Step S60, the controller 114 receives information indicating the temperature of the first dryer roller 64*a* from the first detection section 64*d*. When the controller 114 determines that the temperature of the first dryer roller 64*a* is equal to or higher than the specific temperature T (Yes at Step S60), the routine proceeds to Step S70. When the controller 114 determines that the temperature of the first dryer roller 64*a* is lower than the specific temperature T (No at Step S60), the routine returns to Step S50.

At Step S70, the image forming device 30 forms an image on the sheet S. Specifically, the controller 114 first controls the first conveyor device 20 to convey the sheet S accommodated in the accommodation section 12 toward the image forming device 30. Subsequently, the controller 114 controls the second conveyor device 40 to convey the sheet S under the image forming device 30. The controller 114 then controls the image forming device 30 to form an image on the sheet S based on the image data. In response, the image forming device 30 ejects ink toward the sheet S to form the image on the sheet S.

At Step S80, the first decurler 63 conveys the sheet S. Specifically, the controller 114 controls the third conveyor device 50 to convey the sheet S to the first decurler 63. Then, the first and second decurling rollers 63*a* and 63*b* of the first decurler 63 rotate while holding the sheet S therebetween to convey the sheet S. As a result, curling of the sheet S is mitigated.

At Step S90, the second decurler 64 conveys the sheet S. Specifically, the controller 114 controls the guide section 62 to guide the sheet S toward the second decurler 64. That is, the controller 114 causes the third diverging guide 68 to take the third guide posture. As a result, the third diverging guide 68 guides the sheet S to the second decurler 64. Then, the first and second dryer rollers 64*a* and 64*b* of the second decurler 64 rotate while holding the sheet S therebetween to convey the sheet S. Accordingly, the first dryer roller 64*a* at a temperature equal to or higher than the specific temperature T comes in contact with the image formation side S1 of the sheet S. As a result of contact, drying of ink attached to the sheet S can be accelerated. Thus, curling of the sheet S can be effectively mitigated.

The sheet S having passed between the first and second dryer rollers 64*a* and 64*b* reaches the second guide passage 66.

At Step S100, the image forming device 30 forms the image on the sheet S (see Step S70). Thus, the image is formed on the sheet S in a state in which the first heat source 64*e* is not activated.

At Step S110, the first decurler 63 conveys the sheet S (see Step S80).

At Step S120, the controller 114 controls the guide section 62 to guide the sheet S to the third guide passage 67. That is, the controller 114 causes the third diverging guide 68 to take the fourth guide posture. As a result, the sheet S is conveyed to the third guide passage 67 and the second guide passage 66 in the stated order not via the second decurler 64.

The sheet S having reached the second guide passage 66 at Step S90 or S120 may be conveyed to the ejection passage 71 to be ejected onto the exit tray 11. Alternatively, the sheet S having reached the second guide passage 66 may be conveyed to the paper reversing passage 81 and the paper returning passage 82 in the stated order for backside printing on the sheet S.

As described with reference to FIG. 8, the determination section 113 determines whether or not to activate the first heat source 64*e* at Step S30. In the above configuration, unnecessary activation of the first heat source 64*e* can be reduced with a result that efficient activation of the first heat source 64*e* can be achieved. Running cost of the decurling device 61 can be reduced accordingly.

When unnecessary activation of the first heat source 64*e* is reduced, the number of times that members composing the second decurler 64, such as the first and second dryer rollers 64*a* and 64*b* are heated can be reduced. As a result, the lifetime of the second decurler 64 can be extended.

In a situation in which the sheet S need not be heated, the sheet S can be conveyed not via the second decurler 64 as depicted at Step S120. This can reduce the number of times that the second decurler 64 is activated, and therefore, extend the lifetime of the second decurler 64.

Figure 9A:
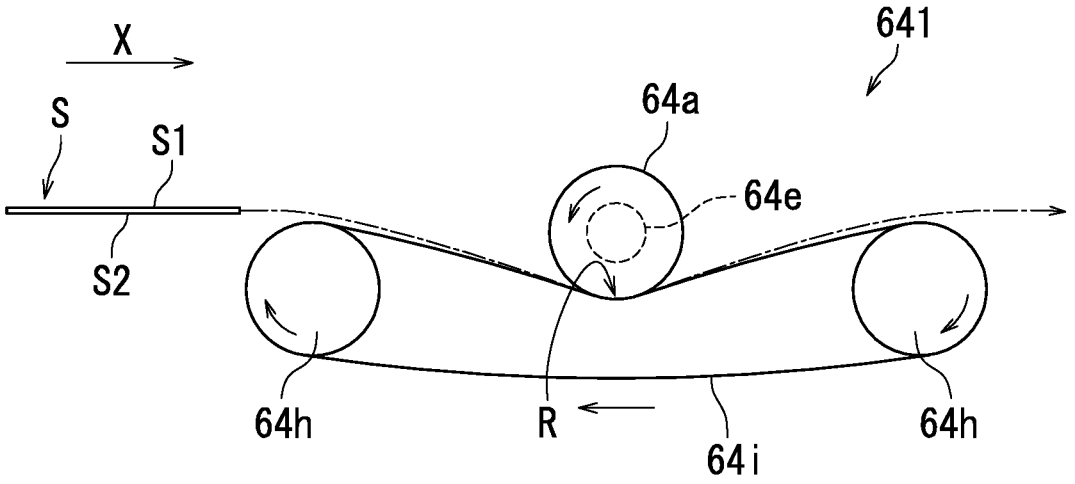
FIG. 9A is a diagram illustrating a first variation of the second decurler in the first embodiment.
Figure 9B:
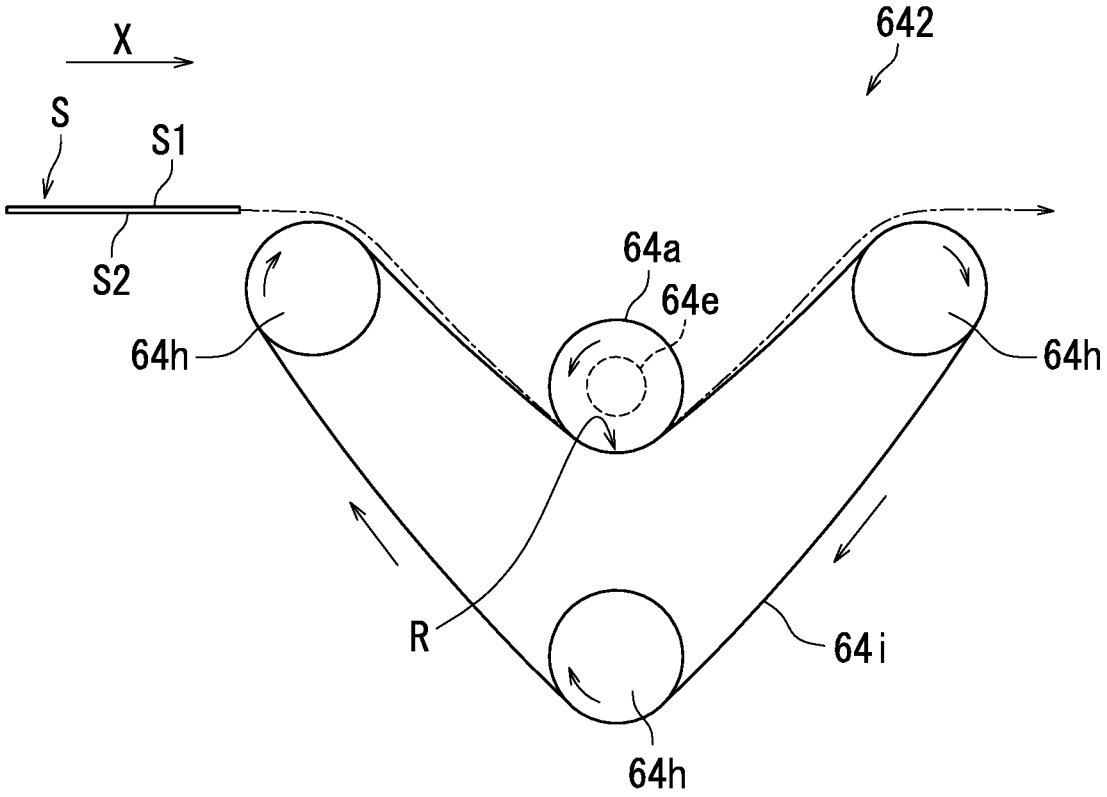
FIG. 9B is a diagram illustrating a second variation of the second decurler in the first embodiment.

The following describes variations of the second decurler 64 with reference to FIGS. 3, 9A, and 9B. FIG. 9A is a diagram illustrating a second decurler 641 that is a first variation of the second decurler 64. The second decurler 64 holds the sheet S between the pair of rollers (first and second dryer rollers 64*a* and 64*b*). By contrast, the second decurler 641 holds the sheet S between a roller and a belt. In the following description, only difference from the second decurler 64 will be described. The same elements of configuration are labelled using the same reference signs, and detailed description thereof is not repeated.

As illustrated in FIGS. 3 and 9A, the second decurler 641 includes the first dryer roller 64*a*, the first heater 64*c*, the first detection section 64*d*, a plurality of support rollers 64*h*, and a dryer belt 64*i*.

The number of the support rollers 64*h* is two in the first variation. The support rollers 64*h* are supported in a rotatable manner. The support rollers 64*h* are spaced from each other. The dryer belt 64*i* is an endless belt. The dryer belt 64*i* is wound between the support rollers 64*h*. The dryer belt 64*i* is supported in a rotatable manner. Specifically, the dryer belt 64*i* is supported by the support rollers 64*h* in a rotatable manner. The dryer belt 64*i* is rotated by rotation of the support rollers 64*h* while in contact with the support rollers 64*h*.

The first dryer roller 64*a* and the dryer belt 64*i* rotate while holding the sheet S therebetween to convey the sheet S. Specifically, the first dryer roller 64*a* and the dryer belt 64*i* rotate while holding the sheet S between the outer circumferential surface of the first dryer roller 64*a* and the outer surface of the dryer belt 64*i*. The outer surface of the dryer belt 64*i* refers to one of surfaces of the dryer belt 64*i* that is opposite to the other surface thereof in contact with the support rollers 64*h*.

The first dryer roller 64*a* holds the sheet S in cooperation with the dryer belt 64*i* between the first dryer roller 64*a* and a specific portion R of the dryer belt 64*i*. The specific portion R refers to a portion of the dryer belt 64*i* located at a position corresponding to the first dryer roller 64*a* that is not opposite to the support rollers 64*h* with the dryer belt 64*i* therebetween. In other words, the specific portion R is a portion of the dryer belt 64*i* that is out of contact with the support rollers 64*h*. In the above configuration, the first dryer roller 64*a* and the dryer belt 64*i* rotate while holding the sheet S between the first dryer roller 64*a* and the specific portion R of the dryer belt 64*i* to convey the sheet S.

The specific portion R of the dryer belt 64*i* receives pressure from the first dryer roller 64*a* to warp. As such, the first dryer roller 64*a* holds the sheet S in cooperation with the dryer belt 64*i* between the first dryer roller 64*a* and a warped portion of the dryer belt 64*i*.

FIG. 9B is a diagram illustrating a second decurler 642 that is a second variation of the second decurler 64. The second decurler 642 is different from the second decurler 641 in that the dryer belt 64*i* is supported by three rollers.

As illustrated in FIGS. 3 and 9B, the second decurler 642 includes the first dryer roller 64*a*, the first heater 64*c*, the first detection section 64*d*, a plurality of support rollers 64*h*, and the dryer belt 64*i*.

The support rollers 64*h* are spaced from one another. The support rollers 64*h* are not aligned. The number of the support rollers 64*h* is three in the second variation. In the second variation, two of the three support rollers 64*h* are disposed on a conveyance path of the sheet S while the other of the support rollers 64*h* is spaced apart from the conveyance path of the sheet S. The first dryer roller 64*a* and the dryer belt 64*i* rotate while holding the sheet S between the first dryer roller 64*a* and the specific portion R of the dryer belt 64*i* to convey the sheet S. That is, the first dryer roller 64*a* holds the sheet S in cooperation with the dryer belt 64*i* between the first dryer roller 64*a* and the warped portion of the dryer belt 64*i*.

As described with reference to FIGS. 3, 9A, and 9B, the first dryer roller 64*a* and the dryer belt 64*i* rotate while holding the sheet S therebetween to convey the sheet S. In the above configuration, a time period for which the sheet S is in contact with the first dryer roller 64*a* can be increased, thereby achieving effective heat transfer from the first heat source 64*e* to the sheet S. As a result, effective acceleration of sheet drying and effective mitigation of sheet curling can be achieved.

When the first dryer roller 64*a* and the dryer belt 64*i* hold the sheet S therebetween, the first dryer roller 64*a* is located opposite to the image formation side S1 of the sheet S. When the first dryer roller 64*a* and the dryer belt 64*i* hold the sheet S therebetween, the dryer belt 64*i* faces the suction side S2 of the sheet S. In the above configuration, the sheet S warps in a direction opposite to a curling direction while being conveyed through rotation of the first dryer roller 64*a* and the dryer belt 64*i* holding the sheet S therebetween. The curling direction refers to a direction in which the sheet S curls. As a result, effective mitigation of sheet curling can be achieved.

Second Embodiment

Figure 10:
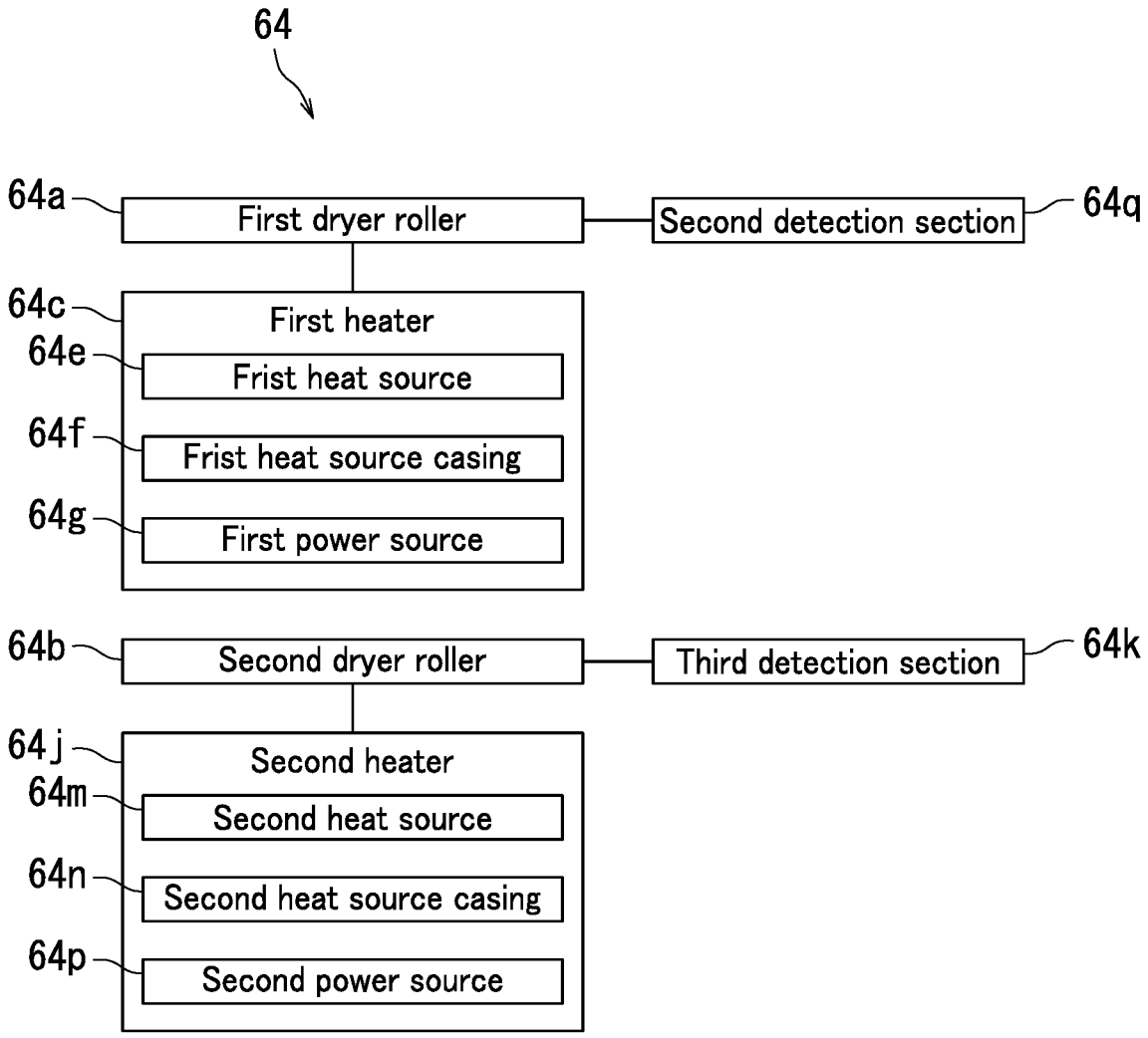
FIG. 10 is a block diagram illustrating a second decurler according to a second embodiment.

The following describes an inkjet recording apparatus 1 according to a second embodiment of the present disclosure with reference to FIGS. 2 and 10. FIG. 10 is a block diagram illustrating a second decurler 64 in the second embodiment. Difference from the first embodiment will be mainly described below.

Specifically, the second decurler 64 includes the first dryer roller 64*a*, the second dryer roller 64*b*, the first heater 64*c*, a second detection section 64*q*, a second heater 64*j*, and a third detection section 64*k*, as illustrated in FIGS. 2 and 10. The first dryer roller 64*a* is an example of the first roller in the present disclosure. The second dryer roller 64*b* is an example of the second roller in the present disclosure.

The second detection section 64*q* detects the temperature of ends of the first dryer roller 64*a*. The ends of the first dryer roller 64*a* are parts of the first dryer roller 64*a* that do not overlap the first heat source 64*e* in terms of an axial direction Z1. The axial direction Z1 refers to a direction along the rotational axis Z of the first dryer roller 64*a*. Detection of the temperature of the ends of the first dryer roller 64*a* encompasses detection of the temperature of the first heat source 64*e* and detection of the temperature of ends of the first heat source casing 64*f*. The ends of the first heat source casing 64*f* refer to parts of the first heat source casing 64*f* that do not overlap the first heat source 64*e* in the axial direction Z1. The second detection section 64*q* is for example constituted by a thermistor.

The second heater 64*j* is for example a halogen heater. Specifically, the second heater 64*j* includes a second power source 64*p*, a second heat source 64*m*, and a second heat source casing 64*n* that accommodates the second heat source 64*m*.

The second heat source 64*m* is a member capable of heat generation. The second heat source 64*m* is for example a filament.

The second heat source 64*m* is disposed at the second dryer roller 64*b*. The second heat source 64*m* is embedded in the second dryer roller 64*b* in the present embodiment. Specifically, the second dryer roller 64*b* has a hollow space in which the second heat source 64*m* is disposed. The second heat source 64*m* is mounted for example at either or both of the second dryer roller 64*b* and a second shaft member. The second shaft member is inserted through the second dryer roller 64*b* to support the second dryer roller 64*b* in a rotatable manner.

The second power source 64*p* supplies power to the second heat source 64*m* to activate the second heat source 64*m*. When activated, the second heat source 64*m* generates heat to increase the temperature of the second dryer roller 64*b*. The second power source 64*p* may be identical with or different from the first power source 64*g*.

The third detection section 64*k* detects the temperature of a central part of the second dryer roller 64*b*. The central part of the second dryer roller 64*b* is a part of the second dryer roller 64*b* that overlaps the second heat source 64*m* in terms of the aforementioned axial direction Z1. Detection of the temperature of the central part of the second dryer roller 64*b* encompasses detection of the temperature of the second heat source 64*m* and detection of the temperature of a central part of the second heat source casing 64*n*. The central part of the second heat source casing 64*n* is a part of the second heat source casing 64*n* that overlaps the second heat source 64*m* in terms of the aforementioned axial direction Z1. The third detection section 64*k* is for example constituted by a thermistor.

As described with reference to FIGS. 2 and 3, the first heat source 64*e* is disposed at the first dryer roller 64*a*. The second heat source 64*m* heats the second dryer roller 64*b*. In the above configuration, drying of ink attached to the sheet S can be accelerated with simple device configuration when compared to a decurling device that blows hot wind toward the sheet S.

Furthermore, the first heat source 64*e* heats the first dryer roller 64*a*. The second heat source 64*m* heats the second dryer roller 64*b*. In the above configuration, when the first and second dryer rollers 64*a* and 64*b* rotate while holding the sheet S therebetween to convey the sheet S, drying of ink attached to the sheet S can be accelerated with use of heat of the first and second dryer rollers 64*a* and 64*b*. As a result, sheet curling can be mitigated and occurrence of problems such as sheet edge folding and a sheet jam can be prevented.

By heating the sheet S using the first and second dryer rollers 64*a* and 64*b*, ink drying can be accelerated by evaporating moisture in ink attached to the sheet S. As a result, need to air-dry ink attached to the sheet S in the third conveyor device 50 is reduced. This can enable reduction in a distance by which the third conveyor device 50 conveys the sheet S or omission of the third conveyor device 50. Thus, size reduction of the inkjet recording apparatus 1 can be achieved.

Figure 11:
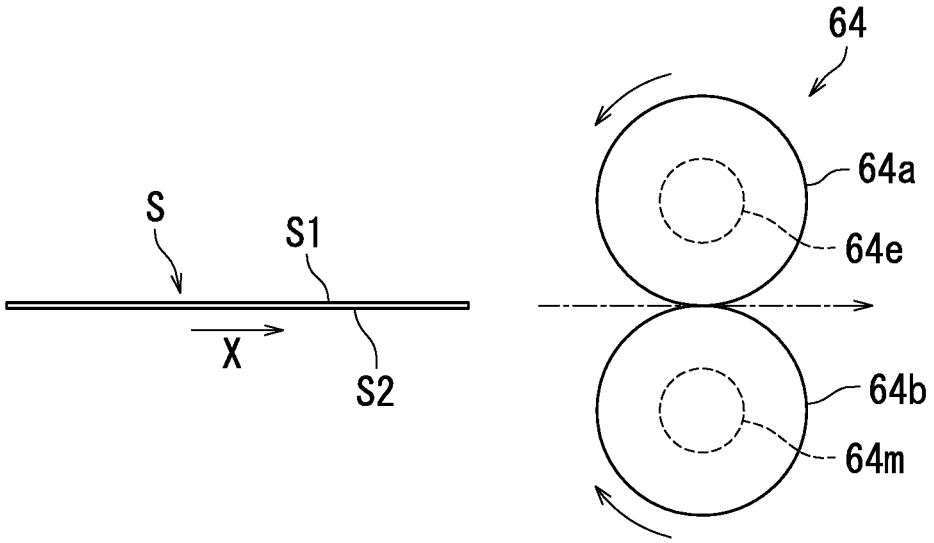
FIG. 11 is a side view of the second decurler according to the second embodiment.

The following describes the second decurler 64 according to the second embodiment with reference to FIGS. 11 to 13B. FIG. 11 is a side view of the second decurler 64. FIG. 12A is a plan view of the first dryer roller 64*a* and the sheet S. FIG. 12B is a diagram illustrating a relationship between regions and temperature of the first heat source casing 64*f*.

Figure 12A:
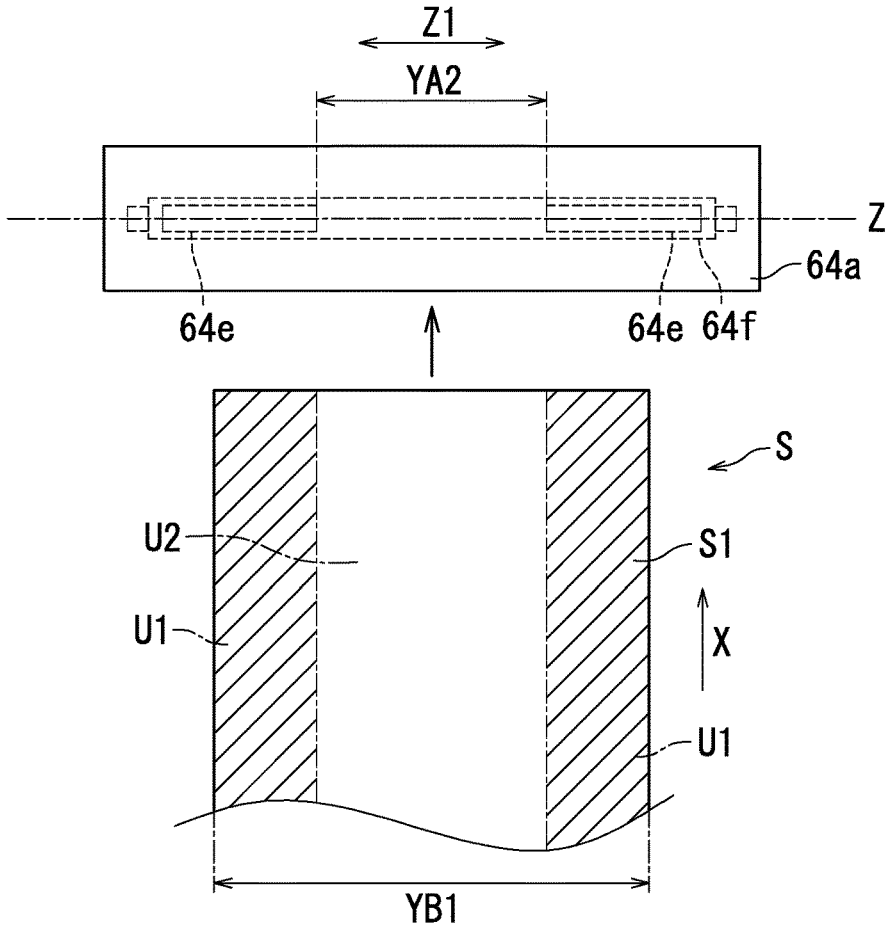
FIG. 12A is a plan view of the first dryer roller and the sheet.
Figure 12B:
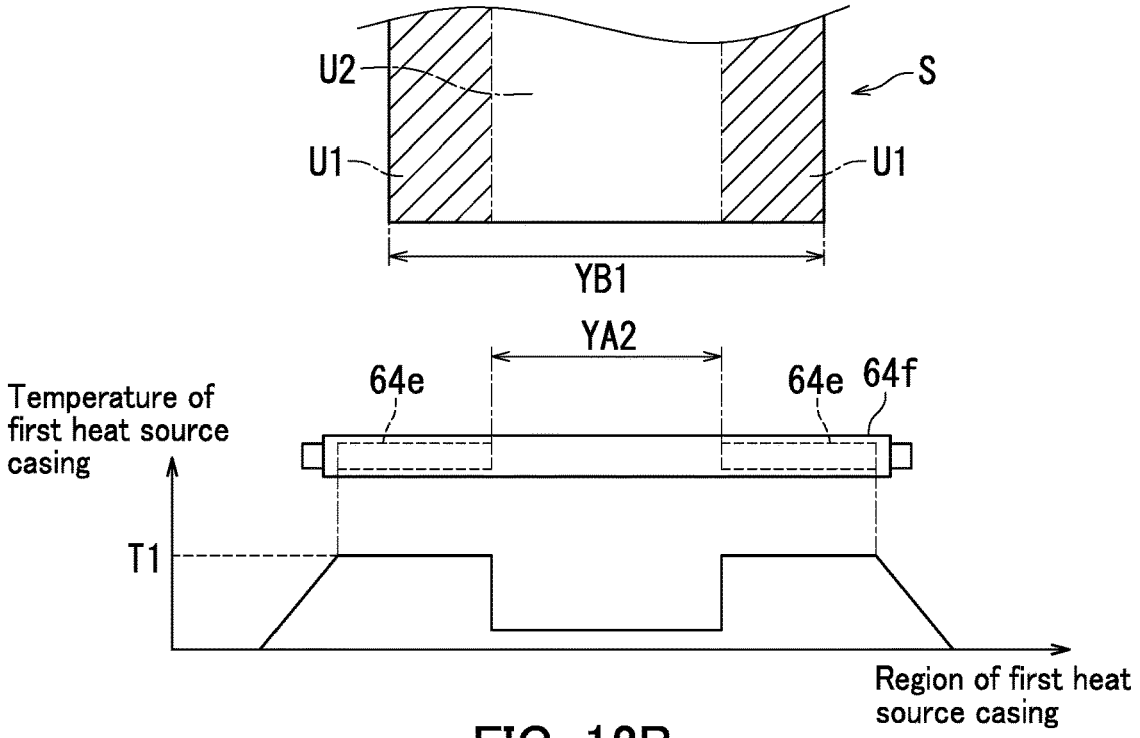
FIG. 12B is a diagram illustrating a relationship between regions and temperature of a first heat source casing.

As illustrated in FIGS. 11 to 12B, the first heat source 64*e* includes a pair of first heat sources 64*e*. The paired first heat sources 64*e* are spaced from each other in terms of the aforementioned axial direction Z1. The first heat sources 64*e* are spaced by a dimension YA2 from each other in terms of the aforementioned axial direction Z1. The dimension YA2 is larger than 0 and smaller than a width YB1 of the sheet S ($0<YA2<YB1$). The width YB1 of the sheet S refers to a dimension of the sheet S in terms of the aforementioned axial direction Z1 when the sheet S is located on the first dryer roller 64*a*.

When the sheet S is held between the first and second dryer rollers 64*a* and 64*b*, the first heat sources 64*e* are located opposite to respective opposite edges U1 of the sheet S in terms of the axial direction Z1. The first heat sources 64*e* heat ends of the first dryer roller 64*a*. Specifically, the first heat sources 64*e* heat respective opposite ends of the first dryer roller 64*a* in terms of the axial direction Z1. As a result, the first heat sources 64*e* heat the respective opposite edges U1 of the sheet S in terms of the aforementioned axial direction Z1.

Parts of the first heat source casing 64*f* located opposite to the respective first heat sources 64*e* are heated substantially uniformly to a specific first temperature T1. As a result, respective parts of the first dryer roller 64*a* located opposite to the first heat sources 64*e* are heated to the specific first temperature T1. Note that the specific first temperature T1 is determined in advance. The specific first temperature T1 is a temperature suitable for acceleration of drying of ink attached to the opposite edges U1 of the sheet S, and is determined for example by an experiment.

Figure 13A:
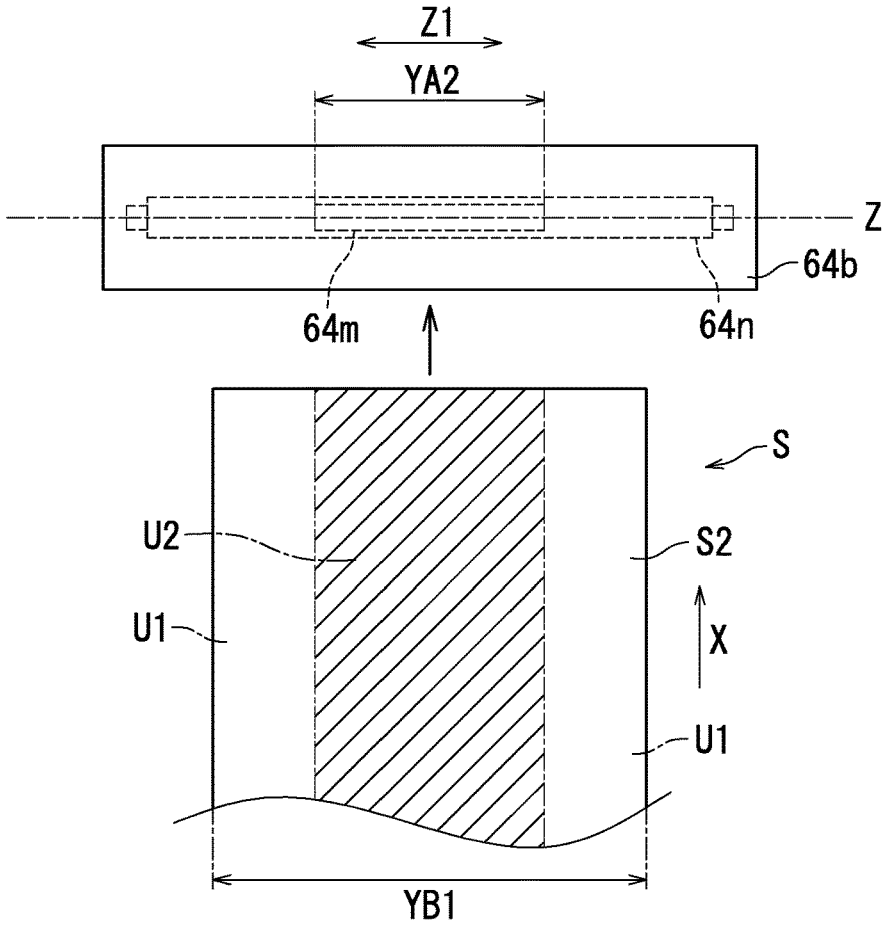
FIG. 13A is a plan view of a second dryer roller and the sheet.
Figure 13B:
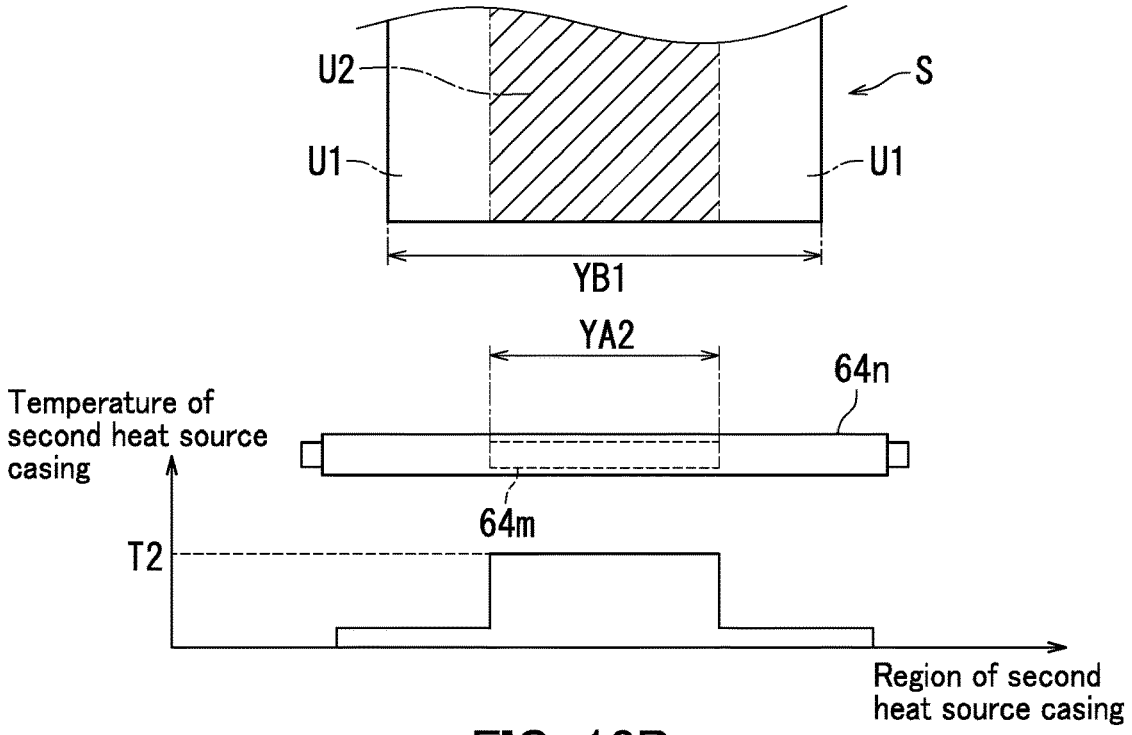
FIG. 13B is a diagram illustrating a relationship between regions and temperature of a second heat source casing.

FIG. 13A is a plan view of the second dryer roller 64*b* and the sheet S. FIG. 13B is a diagram illustrating a relationship between regions and temperature of the second heat source casing 64*n*.

As illustrated in FIGS. 11, 13A, and 13B, the second heat source 64*m* is disposed substantially between the first heat sources 64*e* in terms of the aforementioned axial direction Z1. That is, the second heat source 64*m* has a dimension in terms of the aforementioned axial direction Z1 that is equal to or slightly larger than the dimension YA2.

When the sheet S is held between the first and second dryer rollers 64*a* and 64*b*, the second heat source 64*m* is located opposite to a central part U2 of the sheet S in terms of the aforementioned axial direction Z1. The second heat source 64*m* heats the central part of the second dryer roller 64*b* in terms of the aforementioned axial direction Z1. As a result, the second heat source 64*m* heats the central part U2 of the sheet S in terms of the aforementioned axial direction Z1.

A part of the second heat source casing 64*n* that is located opposite to the second heat source 64*m* is heated substantially uniformly to a specific second temperature T2. As a result, a part of the second dryer roller 64*b* located opposite to the second heat source 64*m* is heated to the specific second temperature T2. Note that the specific second temperature T2 is determined in advance. The specific second temperature T2 is a temperature suitable for acceleration of drying ink attached to the central part U2 of the sheet S, and is determined for example by an experiment. The specific first and second temperatures T1 and T2 may be equal to or different from each other.

When the first and second dryer rollers 64*a* and 64*b* hold the sheet S therebetween, the first dryer roller 64*a* is opposite to the image formation side S1 of the sheet S while the second dryer roller 64*b* is opposite to the suction side S2 of the sheet S. The first dryer roller 64*a* accordingly heats the opposite edges U1 of the sheet S from the image formation side S1 thereof. By contrast, the second dryer roller 64*b* heats the central part U2 of the sheet S from the suction side S2 thereof.

The first and second dryer rollers 64*a* and 64*b* rotate while holding the sheet S therebetween. In the above configuration, the sheet S passes between the first and second dryer rollers 64*a* and 64*b* while receiving heat from the first and second dryer rollers 64*a* and 64*b*.

As described with reference to FIGS. 11 to 13B, the first and second dryer rollers 64*a* and 64*b* heat different regions of the sheet S. In the above configuration, a to-be-heated region of the sheet S can be changed so as to correspond to a region of the sheet S to which ink is attached. As a result, unnecessary activation of the first heat sources 64*e* and the second heat source 64*m* can be reduced with a result that running cost of an apparatus can be reduced.

Typically, the opposite edges U1, rather than the central part U2, of the sheet S tend to curl upon ink attachment. Therefore, heating the opposite edges U1 of the sheet S from the image formation side S1 thereof by the first dryer roller 64*a* can achieve effective heating of the opposite edges U1 of the sheet S and effective mitigation of sheet curling.

Figure 14:
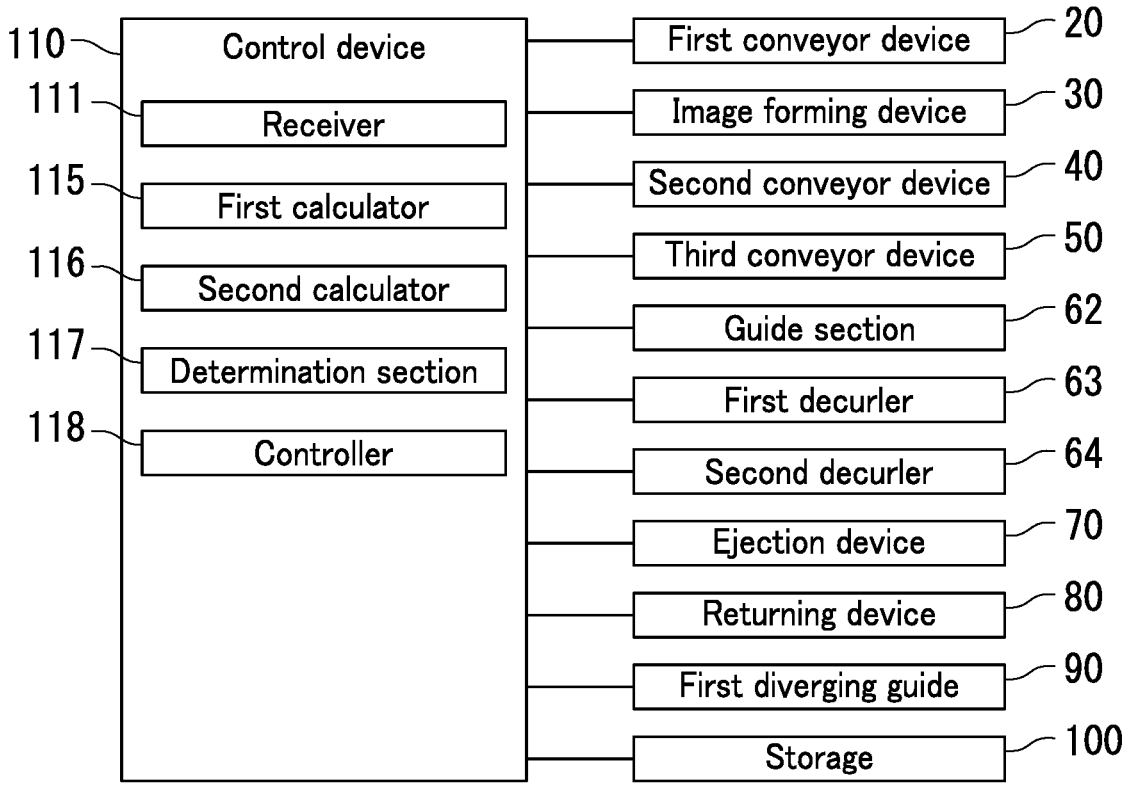
FIG. 14 is a block diagram illustrating an inkjet recording apparatus according to the second embodiment.
Figure 15A:
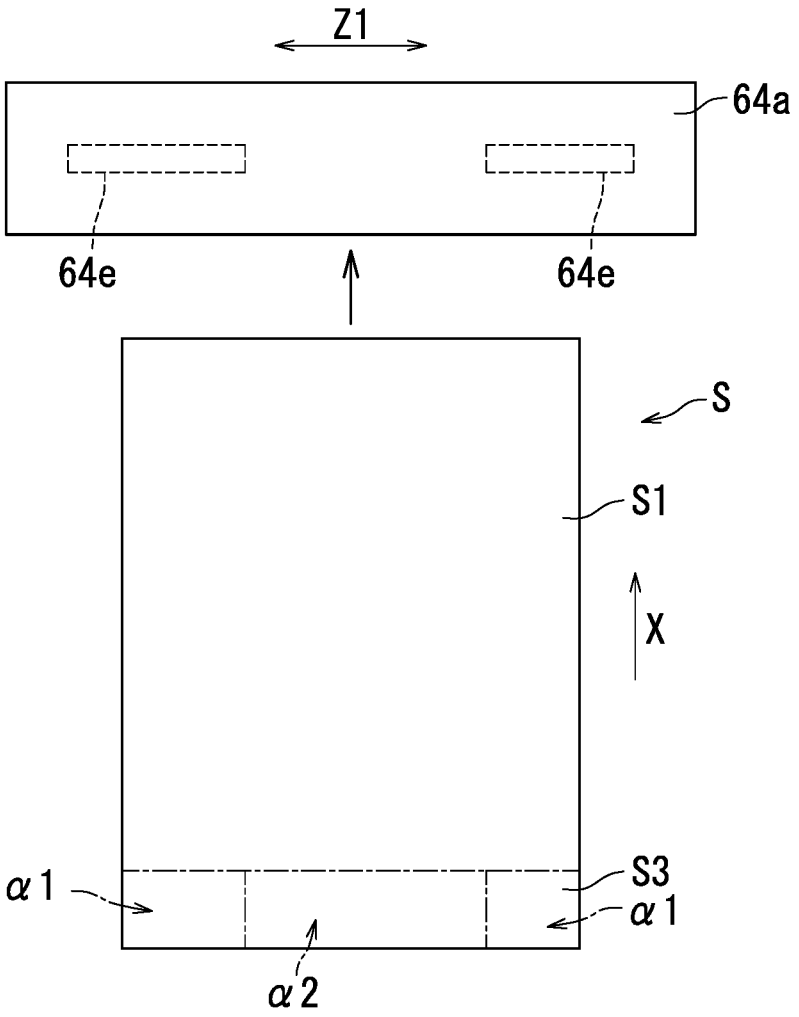
FIG. 15A is a plan view of the first dryer roller and the sheet.
Figure 15B:
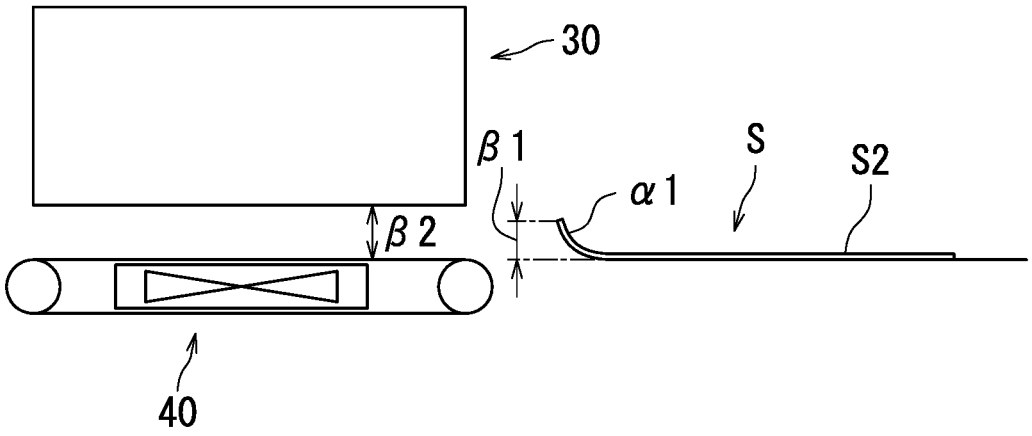
FIG. 15B is a side view of the image forming device and the sheet.

The following describes the inkjet recording apparatus 1 according to the second embodiment with reference to FIGS. 14 to 15B. FIG. 14 is a block diagram illustrating the inkjet recording apparatus 1. FIG. 15A is a plan view illustrating the first dryer roller 64*a* and the sheet S in frontside printing on the sheet S. FIG. 15B is a side view of the image forming device 30 and the sheet S in backside printing on the sheet S.

As illustrated in FIGS. 14 to 15B, the inkjet recording apparatus 1 includes the storage 100 and the control device 110.

The storage 100 stores therein information indicating the specific first temperature T1 and information indicating the specific second temperature T2.

The control device 110 includes the receiver 111, a first calculator 115, a second calculator 116, the determination section 113, and a controller 118. Specifically, a processor executes computer programs stored in a storage device of the storage 100 to function as the receiver 111, the first and second calculators 115 and 116, the determination section 113, and the controller 118.

The first calculator 115 acquires image data from the receiver 111. The first calculator 115 calculates a first ink ejection amount based on the image data. Specifically, the first ink ejection amount refers to an amount of ink that the image forming device 30 is to eject toward first regions α1 of a trailing edge S3 of the sheet S, as illustrated in FIG. 15A. The trailing edge S3 of the sheet S refers to a trailing edge of the sheet S in the sheet conveyance direction X in frontside printing on the sheet S. The first regions α1 refer to regions of the trailing edge S3 of the sheet S that are located on respective opposite sides of the sheet S in a width direction of the sheet S. The width direction of the sheet S refers to a direction perpendicular to the sheet conveyance direction X and parallel to the image formation side S1 of the sheet S. The first regions α1 represent for example regions liable to curl upon ink attachment. The size of the first regions α1 is determined for example by an experiment. Information indicating the first regions α1 is stored in the storage 100 in advance.

The second calculator 116 acquires the image data from the receiver 111. The second calculator 116 calculates a second ink ejection amount based on the image data. The second ink ejection amount refers to an amount of ink that the image forming device 30 is to eject toward a second region α2 of the trailing edge S3 of the sheet S. The second region α2 refers to a region of the trailing edge S3 of the sheet S that occupies a central part thereof in the width direction thereof. The second region α2 represents for example a region liable to curl upon ink attachment. The size of the second region α2 is determined for example by an experiment. Information indicating the second region α2 is stored in the storage 100 in advance.

The determination section 113 determines whether or not to activate the first heat sources 64*e* based on the first ink ejection amount calculated by the first calculator 115. Activation of the first heat sources 64*e* means power supply to the first heat sources 64*e* by the first power source 64*g* to increase the temperature of the first heat sources 64*e*.

When the first ink ejection amount calculated by the first calculator 115 is larger than a specific first reference amount, the determination section 113 determines to activate the first heat sources 64*e*. By contrast, when the first ink ejection amount calculated by the first calculator 115 is equal to or smaller than the specific first reference amount, the determination section 113 determines not to activate the first heat sources 64*e*. Non-activation of the first heat sources 64*e* means no power supply by the first power source 64*g* to the first heat sources 64*e*. The specific first reference amount indicates a maximum value of the ink ejection amount in the first regions α1 in a condition in which the sheet S can be smoothly conveyed with occurrence of problems such as a sheet jam prevented. The specific first reference amount is determined for example by an experiment. Information indicating the specific first reference amount is stored in the storage 100 in advance.

The following describes an example of the specific first reference amount with reference to FIG. 15B. The specific first reference amount indicates for example a maximum value of the ink ejection amount in the first regions α1 when a curl in the first regions α1 of the sheet S has a height β1 smaller than the distance β2 between the image forming device 30 and the second conveyor device 40. The determination section 113 determines to activate the first heat sources 64*e* when the ink ejection amount of ink to be ejected toward the first regions α1 is large and the curl is presumed to have a height β1 larger than the distance β2. By contrast, the determination section 113 determines not to activate the first heat sources 64*e* when the ink ejection amount of ink to be ejected toward the first regions α1 is small and the curl is presumed to have a height β1 smaller than the distance β2.

The trailing edge S3 of the sheet S comes first in backside printing on the sheet S. When the specific first reference amount is set as in the above example, the first regions α1 of the sheet S can be prevented from coming into contact with the image forming device 30 in backside printing on the sheet S. Furthermore, unnecessary activation of the first heat sources 64*e* can be reduced. Thus, efficient activation of the first heat sources 64*e* can be achieved.

The determination section 113 also determines whether or not to activate the second heat source 64*m* based on the second ink ejection amount calculated by the second calculator 116.

When the second ejection amount calculated by the second calculator 116 is larger than a specific second reference amount, the determination section 113 determines to activate the second heat source 64*m*. By contrast, when the second ejection amount calculated by the second calculator 116 is equal to or smaller than the specific second reference amount, the determination section 113 determines not to activate the second heat source 64*m*. The specific second reference amount indicates for example a maximum value of the ink ejection amount in the second region α2 in a condition in which the sheet S can be smoothly conveyed with occurrence of problems such as a sheet jam prevented. The specific second reference amount is determined for example by an experiment. Information indicating the specific second reference amount is stored in the storage 100 in advance.

An example of the specific second reference amount is a maximum value of the ink ejection amount in the second region α2 when a curl in the second region α2 of the sheet S has a height smaller than the distance β2 between the image forming device 30 and the second conveyor device 40.

When the specific second reference amount is set as in the above example, the second region β2 of the sheet S can be prevented from coming into contact with the image forming device 30 in backside printing on the sheet S. Furthermore, unnecessary activation of the second heat source 64*m* can be reduced. Thus, efficient activation of the second heat source 64*m* can be achieved.

Description of the controller 118 will be continued with reference to FIG. 14.

The controller 118 controls the first heat sources 64*e*, the second heat source 64*m*, and the image forming device 30 based on a determination result of the determination section 113.

The controller 118 is connected to the second decurler 64 to control the second decurler 64. Specifically, the controller 118 controls the first and second dryer rollers 64*a* and 64*b*, the first and second heaters 64*c* and 64*j*, and the second and third detection sections 64*q* and 64*k*.

Figure 16:
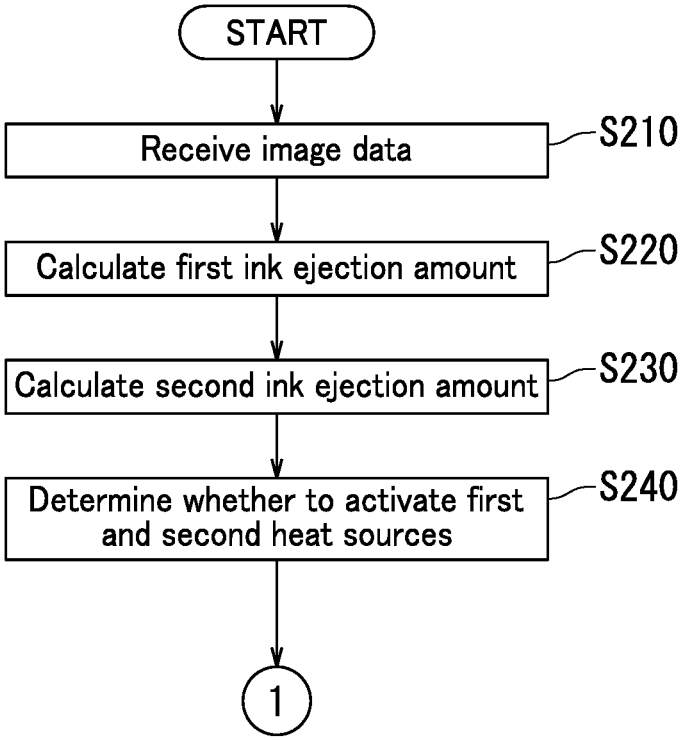
FIG. 16 is a flowchart depicting operation of the control device.
Figure 17:
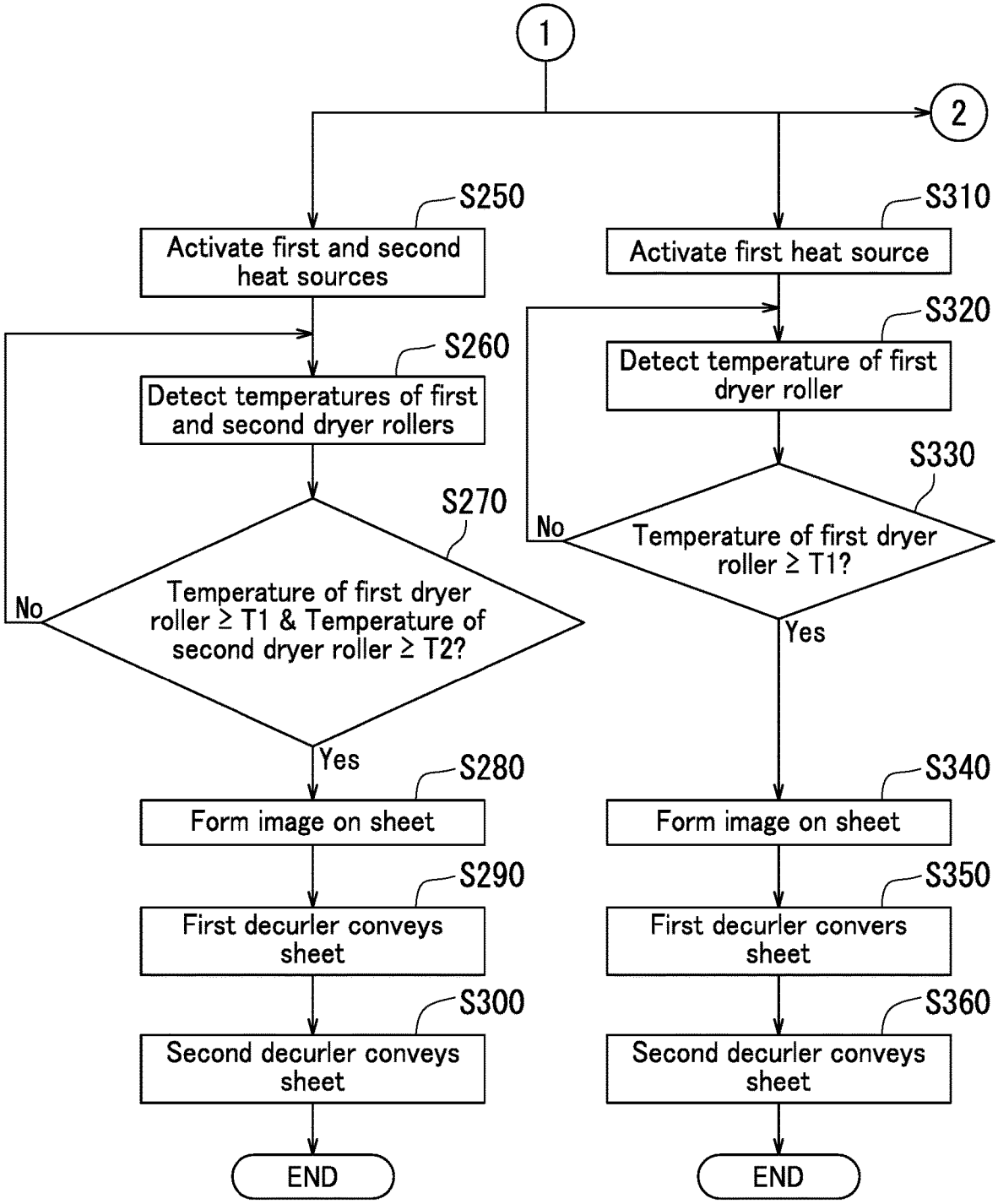
FIG. 17 is a flowchart depicting operation of the control device.
Figure 18:
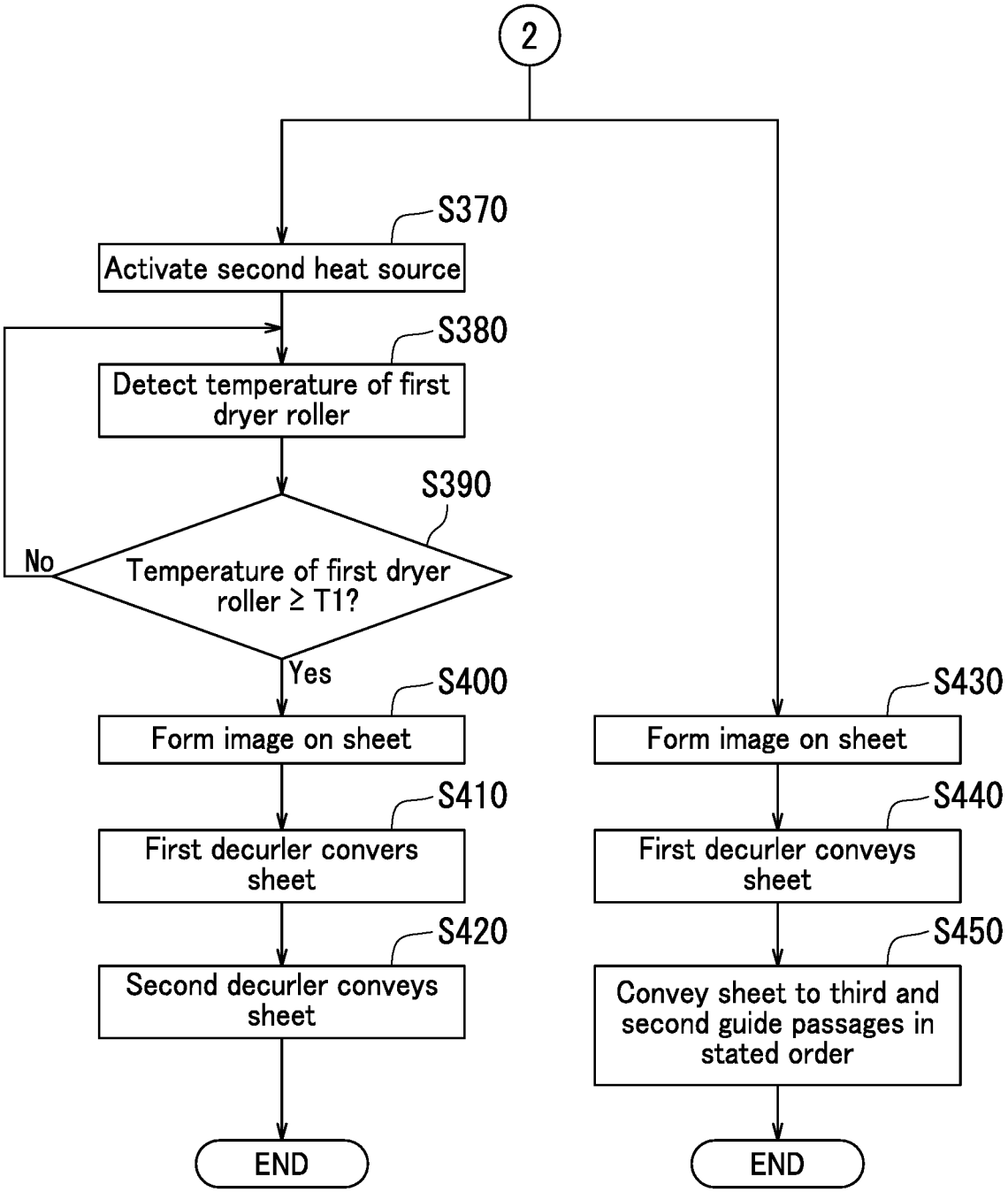
FIG. 18 is a flowchart depicting operation of the control device.

The following describes operation of the control device 110 with reference to FIGS. 16 to 18. FIGS. 16 to 18 are exemplary flowcharts depicting the operation of the control device 110.

At Step S210, the receiver 111 receives image data representing an image to be formed on a sheet S, as depicted in FIG. 16. The image data is transmitted for example from an external computer to the receiver 111.

The first calculator 115 acquires the image data from the receiver 111 at Step S220. The first calculator 115 calculates a first ink ejection amount of ink to be ejected toward the first regions α1 of the sheet S.

The second calculator 116 acquires the image data from the receiver 111 at Step S230. The second calculator 116 calculates a second ink ejection amount of ink to be ejected toward the second region α2 of the sheet S.

At Step S240, the determination section 113 determines whether or not to activate the first heat sources 64*e* and the second heat source 64*m* based on the first ink ejection amount calculated by the first calculator 115 and the second ink ejection amount calculated by the second calculator 116. That is, the determination section 113 determines prior to image formation on the sheet S whether or not to activate the first heat sources 64*e* and the second heat source 64*m*.

When the first ink ejection amount is larger than the specific first reference amount and the second ink ejection amount is larger than the specific second reference amount, the determination section 113 makes first determination. The first determination refers to determination to activate the first heat sources 64*e* and the second heat source 64*m*.

When the first ink ejection amount is larger than the specific first reference amount and the second ink ejection amount is equal to or smaller than the specific second reference amount, the determination section 113 makes second determination. The second determination refers to determination to activate the first heat sources 64*e* and not to activate the second heat source 64*m*.

When the first ink ejection amount is equal to or smaller than the specific first reference amount and the second ink ejection amount is larger than the specific second reference amount, the determination section 113 makes third determination. The third determination refers to determination to activate the second heat source 64*m* and not to activate the first heat sources 64*e*.

When the first ink ejection amount is equal to or smaller than the specific first reference amount and the second ink ejection amount is equal to or smaller than the specific second reference amount, the determination section 113 makes fourth determination. The fourth determination refers to determination not to activate the first heat sources 64*e* and the second heat source 64*m*.

When the determination section 113 makes the first determination, the routine proceeds to Step S250. When the determination section 113 makes the second determination, the routine proceeds to Step S310. When the determination section 113 makes the third determination, the routine proceeds to Step S370. When the determination section 113 makes the fourth determination, the routine proceeds to Step S430.

As depicted in FIG. 17, the controller 118 activates the first heat sources 64*e* and the second heat source 64*m* at Step S250.

At Step S260, the second detection section 64*q* detects the temperature of the ends of the first dryer roller 64*a*. The third detection section 64*k* detects the temperature of the central part of the second dryer roller 64*b*.

At Step S270, the controller 118 receives information indicating the temperature of the ends of the first dryer roller 64*a* from the second detection section 64*q*. The controller 118 also receives information indicating the temperature of the central part of the second dryer roller 64*b* from the third detection section 64*k*. When the controller 118 determines that the temperature of the ends of the first dryer roller 64*a* is equal to or higher than the specific first temperature T1 and the temperature of the central part of the second dryer roller 64*b* is equal to or higher than the specific second temperature T2 (Yes at Step S270), the routine proceeds to Step S280. When the controller 118 determines that the temperature of the ends of the first dryer roller 64*a* is lower than the specific first temperature T1 and/or the temperature of the central part of the second dryer roller 64*b* is lower than the specific second temperature T2 (No at Step S270), the routine returns to Step S260.

At Step S280, the image forming device 30 forms an image on the sheet S. Specifically, the controller 118 first controls the first conveyor device 20 to convey the sheet S accommodated in the accommodation section 12 toward the image forming device 30. The controller 118 then controls the second conveyor device 40 to convey the sheet S under the image forming device 30. The controller 118 next controls the image forming device 30 to form the image on the sheet S. In response, the image forming device 30 ejects ink toward the sheet S to form the image on the sheet S.

At Step S290, the first decurler 63 conveys the sheet S. Specifically, the controller 118 first controls the third conveyor device 50 to convey the sheet S to the first decurler 63. In response, the first and second decurling rollers 63*a* and 63*b* of the first decurler 63 rotate while holding the sheet S therebetween to convey the sheet S. Thus, sheet curling is mitigated.

At Step S300, the second decurler 64 conveys the sheet S. Specifically, the controller 118 first controls the guide section 62 to guide the sheet S toward the second decurler 64. That is, the controller 118 causes the third diverging guide 68 to take the third guide posture. As a result, the third diverging guide 68 guides the sheet S to the second decurler 64. Then, the first and second dryer rollers 64*a* and 64*b* of the second decurler 64 rotate while holding the sheet S therebetween to convey the sheet S. As such, the first dryer roller 64*a* having the ends of which temperature is equal to or higher than the specific first temperature T1 comes into contact with the image formation side S1 of the sheet S. On the other hand, the second dryer roller 64*b* having the central part of which temperature is equal to or higher than the specific second temperature T2 comes into contact with the suction side S2 of the sheet S. As a result of contact, drying of ink attached to the opposite edges U1 and the central part U2 of the sheet S can be accelerated. Thus, effective mitigation of sheet curling at the opposite edges U1 and the central part U2 of the sheet S can be achieved.

The sheet S having passed through the second decurler 64 reaches the second guide passage 66.

At Step S310, the controller 118 activates the first heat sources 64*e*. The controller 118 does not activate the second heat source 64*m*.

At Step S320, the second detection section 64*q* detects the temperature of the first dryer roller 64*a*.

At Step S330, the controller 118 receives information indicating the temperature of the first dryer roller 64*a* from the second detection section 64*q*. When the controller 118 determines that the temperature of the first dryer roller 64*a* is equal to or higher than the specific first temperature T1 (Yes at Step S330), the routine proceeds to Step S340. When the controller 118 determines that the temperature of the first dryer roller 64*a* is lower than the specific first temperature T1 (No at Step S330), the routine returns to Step S320.

At Step S340, the image forming device 30 forms an image on the sheet S (see Step S280).

At Step S350, the first decurler 63 conveys the sheet S (see Step S290).

At Step S360, the second decurler 64 conveys the sheet S (see Step S300). The first dryer roller 64*a* having the ends of which temperature is equal to or higher than the specific first temperature T1 comes into contact with the image formation side S1 of the sheet S. As a result of contact, drying of ink attached to the opposite edges U1 of the sheet S can be accelerated, and effective mitigation of sheet curling at the opposite edges U1 of the sheet S can be achieved.

The sheet S having passed through the second decurler 64 reaches the second guide passage 66.

As depicted in FIG. 18, the controller 118 activates the second heat source 64*m* at Step S370. The controller 118 does not activate the first heat sources 64*e*.

At Step S380, the third detection section 64*k* detects the temperature of the central part of the second dryer roller 64*b*.

At Step S390, the controller 118 receives information indicating the temperature of the second dryer roller 64*b* from the third detection section 64*k*. When the controller 118 determines that the temperature of the second dryer roller 64*b* is equal to or higher than the specific second temperature T2 (Yes at Step S390), the routine proceeds to Step S400. When the controller 118 determines that the temperature of the second dryer roller 64*b* is lower than the specific second temperature T2 (No at Step S390), the routine returns to Step S380.

At Step S400, the image forming device 30 forms an image on the sheet S (see Step S280).

At Step S410, the first decurler 63 conveys the sheet S (see Step S290).

At Step S420, the second decurler 64 conveys the sheet S (see Step S300). The second dryer roller 64*b* having the central part of which temperature is equal to or higher than the specific second temperature T2 comes into contact with the suction side S2 of the sheet S. As a result of contact, drying of ink attached to the central part U2 of the sheet S can be accelerated. Thus, effective mitigation of sheet curling at the central part U2 of the sheet S can be achieved.

The sheet S having passed through the second decurler 64 reaches the second guide passage 66.

At Step S430, the image forming device 30 forms an image on the sheet S (see Step S280). Thus, the image is formed on the sheet S in a state in which the first heat sources 64*e* and the second heat source 64*m* are not activated.

At Step S440, the first decurler 63 conveys the sheet S (see Step S290).

At Step S450, the controller 118 controls the guide section 62 to guide the sheet S to the third guide passage 67. That is, the controller 118 causes the third diverging guide 68 to take the fourth guide posture. As a result, the sheet S is conveyed to the third guide passage 67 and the second guide passage 66 in the stated order not via the second decurler 64.

Alternatively, after reaching the second guide passage 66 at any of Steps S300, S360, S420, and S450, the sheet S may be conveyed to the ejection passage 71 and ejected onto the exit tray 11. Or, the sheet S having reached the second guide passage 66 may be conveyed to the paper reversing passage 81 and the paper returning passage 82 in the stated order for backside printing on the sheet S.

As described above with reference to FIGS. 16 to 18, the determination section 113 determines whether or not to activate the first heat sources 64*e* and the second heat source 64*m* at Step S440. In the above configuration, unnecessary activation of the first heat sources 64*e* and the second heat source 64*m* can be reduced with a result that efficient activation of the first heat sources 64*e* and the second heat source 64*m* can be achieved. Consequently, running cost of the decurling device 61 can be reduced.

As depicted at Step S440, a to-be-heated region of the sheet S can be selected from among a plurality of regions of the sheet S. The plurality of regions are the opposite edges U1 and the central part U2 in the present embodiment. In the above configuration, a to-be-heated region of the sheet S can be selected in correspondence with a region of the sheet S to which ink is attached. Consequently, running cost of the apparatus can be effectively reduced.

By not unnecessarily activating the first heat sources 64*e* and the second heat source 64*m*, the number of times that members of the second decurler 64, such as the first and second dryer rollers 64*a* and 64*b* are heated by heat of the first heat sources 64*e* and the second heat source 64*m* can be reduced. As a result, the lifetime of the second decurler 64 can be extended.

Furthermore, in a situation in which the sheet S need not be heated, the sheet S can be conveyed not via the second decurler 64 as depicted at Step S450. As a result, the number of times that the second decurler 64 is activated can be reduced and the lifetime of the second decurler 64 can be extended.

Figure 19A:
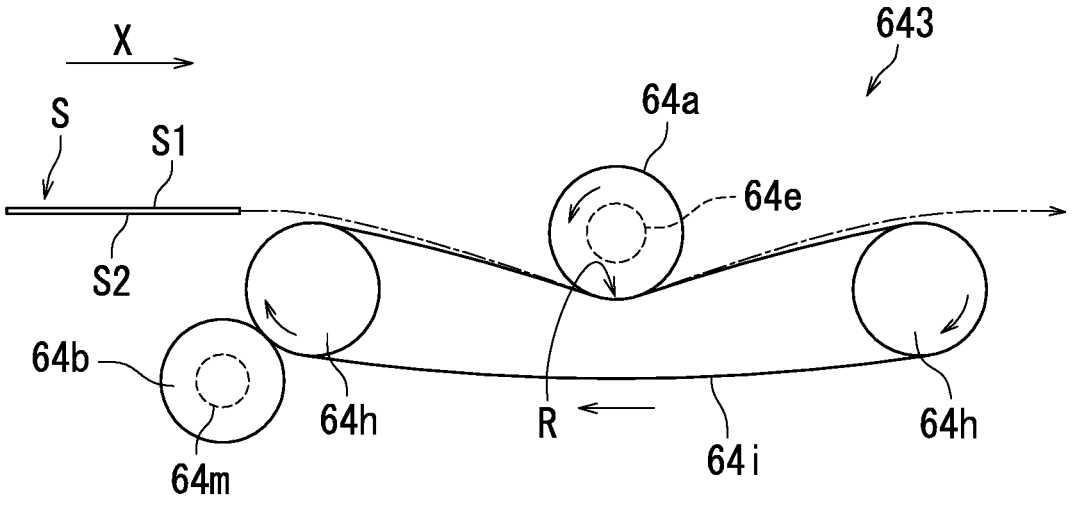
FIG. 19A is a diagram illustrating a third variation of the second decurler in the second embodiment.
Figure 19B:
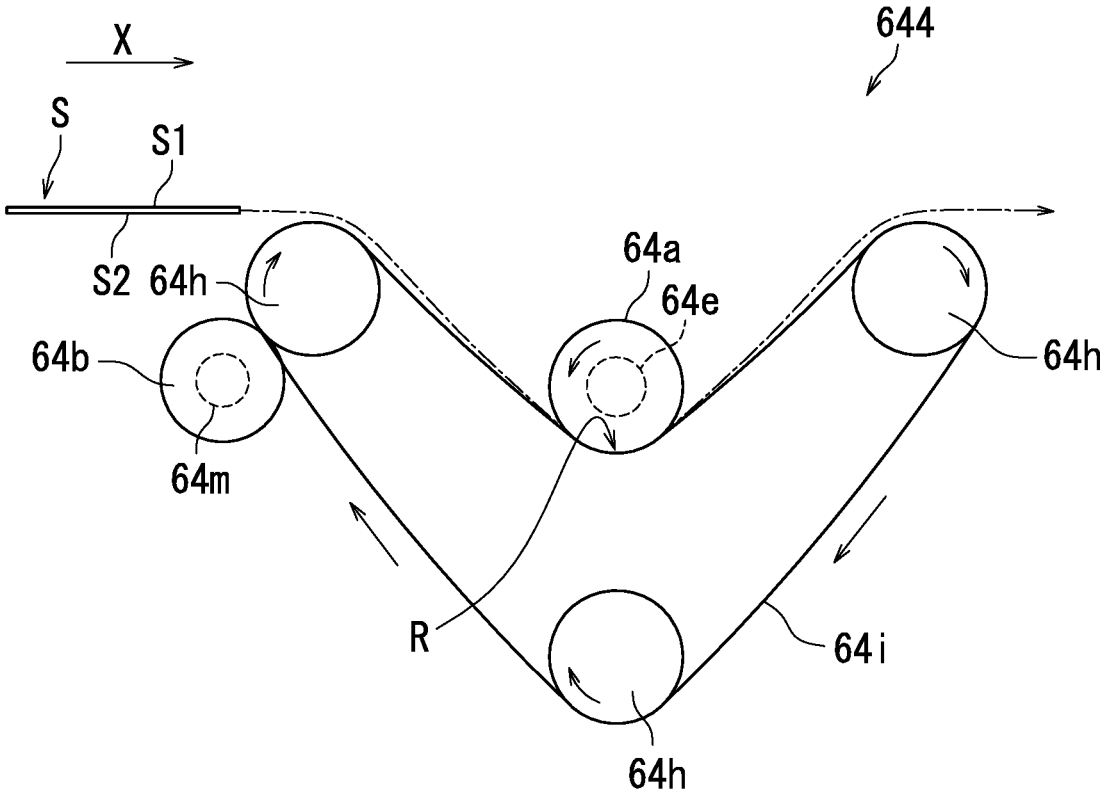
FIG. 19B is a diagram illustrating a fourth variation of the second decurler in the second embodiment.

The following describes variations of the second decurler 64 with reference to FIGS. 10, 19A, and 19B. FIG. 19A is a diagram illustrating a third decurler 643 that is a third variation of the second decurler 64. The second decurler 64 holds the sheet S between the pair of rollers (first and second dryer rollers 64*a* and 64*b*). By contrast, the third decurler 643 holds the sheet S between a roller and a belt. In the following description, only difference from the second decurler 64 will be described. The same elements of configuration are labelled using the same reference signs, and description thereof is not repeated.

As illustrated in FIGS. 10 and 19A, the third decurler 643 includes the first dryer roller 64*a*, the second dryer roller 64*b*, the first heater 64*c*, the second detection section 64*q*, a plurality of support rollers 64*h*, the dryer belt 64*i*, the second heater 64*j*, and the third detection section 64*k*.

The number of the support rollers 64*h* is two in the third variation. The support rollers 64*h* are supported in a rotatable manner. The support rollers 64*h* are spaced from each other. The dryer belt 64*i* is an endless belt. The dryer belt 64*i* is wound between the support rollers 64*h*. The dryer belt 64*i* is supported in a rotatable manner. Specifically, the dryer belt 64*i* is supported by the support rollers 64*h* in a rotatable manner. The dryer belt 64*i* is rotated by rotation of the support rollers 64*h* while in contact with the support rollers 64*h*.

The first dryer roller 64*a* and the dryer belt 64*i* rotate while holding the sheet S therebetween to convey the sheet S. Specifically, the first dryer roller 64*a* and the dryer belt 64*i* rotate while holding the sheet S between the outer circumferential surface of the first dryer roller 64*a* and the outer surface of the dryer belt 64*i*. The outer surface of the dryer belt 64*i* refers to one of surfaces of the dryer belt 64*i* that is opposite to the other surface thereof in contact with the support rollers 64*h*.

The first dryer roller 64*a* holds the sheet S in cooperation with the dryer belt 64*i* between the first dryer roller 64*a* and a specific portion R of the dryer belt 64*i*. The specific portion R refers to a portion of the dryer belt 64*i* located at a position corresponding to the first dryer roller 64*a* that is not opposite to the support rollers 64*h* with the dryer belt 64*i* therebetween. In other words, the specific portion R is a portion of the dryer belt 64*i* that is out of contact with the support rollers 64*h*. In the above configuration, the first dryer roller 64*a* and the dryer belt 64*i* rotate while holding the sheet S between the first dryer roller 64*a* and the specific portion R of the dryer belt 64*i* to convey the sheet S.

The specific portion R of the dryer belt 64*i* receives pressure from the first dryer roller 64*a* to warp. As such, the first dryer roller 64*a* holds the sheet S in cooperation with the dryer belt 64*i* between the first dryer roller 64*a* and a warped portion of the dryer belt 64*i*.

The second dryer roller 64*b* is in contact with the dryer belt 64*i*. Specifically, the second dryer roller 64*b* is in contact with the outer surface of the dryer belt 64*i*. The second dryer roller 64*b* rotates while in contact with the dryer belt 64*i*. Specifically, the second dryer roller 64*b* in contact with the dryer belt 64*i* rotates together with the dryer belt 64*i*.

Heat of the second heat source 64*m* is transferred to the sheet S via the second dryer roller 64*b* and the dryer belt 64*i*. That is, the second heat source 64*m* heats the dryer belt 64*i* to heat the central part U2 of the sheet S through the dryer belt 64*i*.

FIG. 19B is a diagram illustrating a fourth decurler 644 that is a fourth variation of the second decurler 64. The fourth decurler 644 is different from the third decurler 643 in that the dryer belt 64*i* is supported by three rollers.

As illustrated in FIGS. 10 and 19B, the fourth decurler 644 includes the first dryer roller 64*a*, the first heater 64*c*, the second detection section 64*q*, a plurality of support rollers 64*h*, the dryer belt 64*i*, the second heater 64*j*, and the third detection section 64*k*.

The support rollers 64*h* are spaced from one another. The support rollers 64*h* are not aligned. The number of the support rollers 64*h* is three in the fourth variation. In the fourth variation, two of the three support rollers 64*h* are disposed on the conveyance path of the sheet S while the other of the support rollers 64*h* is spaced apart from the conveyance path of the sheet S. The first dryer roller 64*a* and the dryer belt 64*i* rotate while holding the sheet S between the first dryer roller 64*a* and the specific portion R of the dryer belt 64*i* to convey the sheet S. That is, the first dryer roller 64*a* holds the sheet S in cooperation with the dryer belt 64*i* between the first dryer roller 64*a* and a warped portion of the dryer belt 64*i*.

The second dryer roller 64*b* is in contact with the outer surface of the dryer belt 64*i*. The second dryer roller 64*b* in contact with the dryer belt 64*i* rotates together with the dryer belt 64*i*.

Heat of the second heat source 64*m* is transferred to the sheet S through the second dryer roller 64*b* and the dryer belt 64*i*. That is, the second heat source 64*m* heats the dryer belt 64*i* to heat the central part U2 of the sheet S through the dryer belt 64*i*.

As described above with reference to FIGS. 10, 19A, and 19B, the first dryer roller 64*a* and the dryer belt 64*i* rotate while holding the sheet S therebetween to convey the sheet S. In the above configuration, a time period for which the sheet S is in contact with the first dryer roller 64*a* and the dryer belt 64*i* can be increased to achieve effective transfer of heat from the first heat sources 64*e* and the second heat source 64*m* to the sheet S. That is, drying of the opposite edges U1 of the sheet S by heat of the first heat sources 64*e* can be effectively accelerated while drying of the central part U2 of the sheet S by heat of the second heat source 64*m* can be effectively accelerated. Consequently, effective mitigation of sheet curling can be achieved.

When the first dryer roller 64*a* and the dryer belt 64*i* hold the sheet S therebetween, the first dryer roller 64*a* is located opposite to the image formation side S1 of the sheet S. Also, when the first dryer roller 64*a* and the dryer belt 64*i* hold the sheet S therebetween, the dryer belt 64*i* faces the suction side S2 of the sheet S. In the above configuration, the sheet S warps in a direction opposite to a curling direction while being conveyed through rotation of the first dryer roller 64*a* and the dryer belt 64*i* holding the sheet S therebetween. The curling direction refers to a direction in which the sheet S curls. Consequently, effective mitigation of sheet curling can be achieved.

Embodiments of the present disclosure have been described so far with reference to the accompanying drawings (FIGS. 1 to 19B). However, the present disclosure is not limited to the above-described embodiments and can be practiced in various ways within the scope without departing from the essence of the present disclosure (for example, (1) to (10)). Elements of configuration disclosed in the above embodiments can be combined as appropriate in various different forms. For example, some of the elements of configuration indicated in the above embodiments may be omitted. The drawings are schematic illustrations that emphasize elements of configuration in order to facilitate understanding thereof, and the numbers and the like of elements of configuration illustrated in the drawings may differ from actual ones thereof in order to facilitate preparation of the drawings. The elements of configurations in the above embodiments are only examples that do not impose any particular limitations and can be altered in various ways to the extent that there is not substantial deviation from the advantages of the present disclosure.

(1) In the following description, the second decurler 64, the second decurler 641, the second decurler 642, the third decurler 643, and the fourth decurler 644 are referred to generally as a second decurling member. The second decurling member is disposed downstream of the first decurler 63 in terms of the sheet conveyance direction X in the first and second embodiments. However, the second decurling member may be disposed upstream of the first decurler 63 in terms of the sheet conveyance direction X. In the above configuration, the second decurling member heats the sheet S prior to conveyance of the sheet S to the first decurler 63 to accelerate drying of ink on the sheet S. As a result, attachment of ink on the sheet S to rollers (i.e., first and second decurling rollers 63*a* and 63*b*) of the first decurler 63 can be effectively inhibited.

(2) The second decurling member is disposed between the image forming device 30 and the ejection passage 71 in the first and second embodiments. However, it is only required that the second decurling member is disposed downstream of the image forming device 30 in terms of the sheet conveyance direction X. The second decurling member may be for example disposed at the paper returning passage 82. In the above configuration, the second decurling member accelerates drying of ink on the sheet S in the paper returning passage 82 to mitigate curling of the sheet S. As a result, a situation in which the sheet S is rubbed against the image forming device 30 in backside printing on the sheet S can be prevented to achieve smooth backside printing on the sheet S.

(3) A third heat source different from the first heat source 64*e* may be provided at the second dryer roller 64*b* of the second decurler 64 in the first embodiment. In the above configuration, the third heat source heats the second dryer roller 64*b*. As a result, the first and second dryer rollers 64*a* and 64*b* heat the sheet S, thereby achieving effective sheet heating.

Furthermore, it is possible that in each of the second decurler 641 and the second decurler 642, an additional roller in contact with the dryer belt 64*i* is provided and a second heat source different from the first heat source 64*e* is provided at the additional roller. The additional roller rotates while in contact with the dryer belt 64*i*. In the above configuration, the second heat source heats the dryer belt 64*i* through the additional roller. As a result, the first dryer roller 64*a* and the dryer belt 64*i* heat the sheet S, thereby achieving effective sheet heating.

In a configuration in which the second heat source is provided in the second decurling member, the controller 114 or 118 activates the second heat source in synchronization with timing of activation of the first heat source 64*e*.

(4) The decurling device 61 includes the first and second decurlers 63 and 64 in the first and second embodiments. However, the decurling device 61 may include only the second decurler 64. That is, the decurling device 61 not including the first decurler 63 mitigates sheet curling using only the second decurler 64. In the above configuration, the number of components of the device can be reduced.

(5) In the second decurler 64 in the first embodiment, when the first and second dryer rollers 64*a* and 64*b* hold the sheet S therebetween, the first dryer roller 64*a* is located opposite to the image formation side S1 of the sheet S while the second dryer roller 64*b* is located opposite to the suction side S2 of the sheet S. However, it is possible that the first dryer roller 64*a* is located opposite to the suction side S2 of the sheet S while the second dryer roller 64*b* is located opposite to the image formation side S1 of the sheet S. That is, the first dryer roller 64*a* heats the sheet S from the suction side S2 to dry ink attached to the image formation side S1 of the sheet S. However, the first dryer roller 64*a* can directly heat the image formation side S1 of the sheet S to effectively accelerate drying of ink attached to the image formation side S1 of the sheet S in a configuration in which the first dryer roller 64*a* is located opposite to the image formation side S1 of the sheet S, as described in the first embodiment.

(6) The first decurler 63 holds the sheet S between the paired rollers (i.e., the first and second decurling rollers 63*a* and 63*b*) in the first and second embodiments. However, the first decurler 63 may hold the sheet S between the first decurling roller 63*a* and a decurling belt. That is, the first decurler 63 holds the sheet S in the same manner as that adopted in the second decurler 641 or 642 in the first embodiment (see FIGS. 9A and 9B). Also, the first decurler 63 holds the sheet S in the same manner as that adopted in the third decurler 643 or the fourth decurler 644 in the second embodiment (see FIGS. 19A and 19B). Specifically, the first decurler 63 includes the first decurling roller 63*a* supported in a rotatable manner and a decurling belt supported in a rotatable manner. The first decurling roller 63*a* and the decurling belt rotate while holding the sheet S therebetween to convey the sheet S. When the first decurling roller 63*a* and the decurling belt hold the sheet S therebetween, the first decurling roller 63*a* is located opposite to the image formation side S1 of the sheet S. By contrast, when the first decurling roller 63*a* and the decurling belt hold the sheet S therebetween, the decurling belt faces the suction side S2 of the sheet S.

In a configuration in which the first decurler 63 includes the first decurling roller 63*a* and the decurling belt, the sheet S curls in a direction opposite to the curling direction while being conveyed through rotation of the first decurling roller 63*a* and the decurling belt holding the sheet S therebetween. Consequently, effective mitigation of sheet curling can be achieved.

(7) The decurling device 61 in the first and second embodiments may be provided in a post-printing processing device. The post-printing processing device is connected to the inkjet recording apparatus 1. The post-printing processing device performs specific post-printing processing on a sheet S. Examples of the specific post-printing processing include punching and stapling. Punching is processing to perforate a sheet S. Stapling is processing by which a stack of sheets S is bound with a binding piece such as a staple.

(8) A sheet S with an ink image formed thereon is conveyed to the decurling device 61 in the first and second embodiments. The ink image refers to an image formed with ink. However, a sheet S with a liquid different from such ink applied thereon may be conveyed to the decurling device 61. The decurling device 61 mitigates curling of a sheet S wetted with the liquid.

(9) In the second decurling member in the second embodiment, the first heat sources 64*e* are provided at the first dryer roller 64*a* and the second heat source 64*m* is provided at the second dryer roller 64*b*. However, it is possible that the second heat source 64*m* is provided at the first dryer roller 64*a* and the first heat sources 64*e* are provided at the second dryer roller 64*b*. That is, the first dryer roller 64*a* heats the central part U2 of the sheet S while the second dryer roller 64*b* heats the opposite edges U1 of the sheet S. Layout flexibility for the first heat sources 64*e* and the second heat source 64*m* can be accordingly increased.

(10) Both of the first decurler 63 and the second decurling member are disposed in the interior of the casing 10 of the inkjet recording apparatus 1 in the first and second embodiments. However, either or both of the first decurler 63 and the second decurling member may serve as a post-printing processing device. In the above configuration, either or both of the first decurler 63 and the second decurling member are provided in the exterior of the casing 10 and connected to the ejection device 70. In the above configuration, the sheet S ejected from the ejection device 70 is conveyed to either or both of the first decurler 63 and the second decurling member. As a result, either or both of the first decurler 63 and the second decurling member mitigate curling of the sheet S ejected from the ejection device 70.

What is claimed is:

1. An inkjet recording apparatus comprising:

an image forming section configured to form an image on a sheet;

a first roller configured to convey the sheet;

a first heat source configured to heat the first roller;

a calculator configured to calculate an ink ejection amount of ink to be ejected toward the sheet;

a determination section configured to determine whether or not to activate the first heat source based on a calculation result of the calculator; and a controller configured to control the first heat source and the image forming section based on a determination result of the determination section, wherein the determination section determines to activate the first heat source when the ink ejection amount calculated by the calculator is larger than a specific reference amount, when the determination section determines to activate the first heat source, the controller activates the first heat source, and when temperature of the first roller is equal to or higher than a specific temperature, the controller controls the image forming section to form the image on the sheet.

2. The inkjet recording apparatus according to claim 1, further comprising a rotary member supported in a rotatable manner, wherein the first roller and the rotary member rotate while holding the sheet therebetween to convey the sheet.

3. The inkjet recording apparatus according to claim 2, wherein the rotary member is a second roller.

4. The inkjet recording apparatus according to claim 2, wherein the rotary member is a belt.

5. The inkjet recording apparatus according to claim 2, wherein when the first roller and the rotary member hold the sheet therebetween, the first roller is located opposite to an image formation side of the sheet, and the image formation side is a side of the sheet on which the image has been formed.

6. The inkjet recording apparatus according to claim 2, further comprising a second heat source configured to heat the rotary member.

7. The inkjet recording apparatus according to claim 6, wherein the rotary member is a second roller, and the second heat source is disposed at the second roller.

8. The inkjet recording apparatus according to claim 6, further comprising a second roller in contact with the rotary member, wherein the rotary member is a belt, and the second heat source is disposed at the second roller.

* * * * *